US007241078B2

(12) United States Patent
Surges

(10) Patent No.: US 7,241,078 B2
(45) Date of Patent: Jul. 10, 2007

(54) MODULAR PIER SYSTEM

(75) Inventor: Carl James Surges, Conover, WI (US)

(73) Assignee: Pier of d'Nort Corp., Conover, WI (US)

( * ) Notice: Subject to any disclaimer, the term of this patent is extended or adjusted under 35 U.S.C. 154(b) by 0 days.

(21) Appl. No.: 10/888,091

(22) Filed: Jul. 9, 2004

(65) Prior Publication Data

US 2005/0008437 A1 Jan. 13, 2005

Related U.S. Application Data

(60) Provisional application No. 60/486,618, filed on Jul. 11, 2003.

(51) Int. Cl.
*E01D 19/02* (2006.01)
*F16B 21/02* (2006.01)

(52) U.S. Cl. ..... 405/220; 14/75; 403/321

(58) Field of Classification Search ..... 405/218, 405/220, 224; 403/321, 322.4, 326
See application file for complete search history.

(56) References Cited

U.S. PATENT DOCUMENTS

| | | | | |
|---|---|---|---|---|
| 1,358,951 | A | 11/1920 | Helmich | 405/221 |
| 2,306,311 | A | 12/1942 | Holland | 14/2.4 |
| 2,618,124 | A | 11/1952 | Holsten | 405/220 |
| 2,948,121 | A | 8/1960 | Karst | 405/220 |
| 3,421,327 | A | 1/1969 | Donaldson | 405/220 |
| 3,492,825 | A | 2/1970 | Pearson | 405/219 |
| 3,568,451 | A | 3/1971 | Gustin | 405/221 |
| 3,614,871 | A | 10/1971 | Nordell | 405/221 |
| 3,686,876 | A | 8/1972 | Muschell | 405/220 |
| 3,952,528 | A | 4/1976 | Donkersloot | 405/221 |
| 4,008,506 | A | 2/1977 | Smith | 14/71.1 |
| 4,074,537 | A * | 2/1978 | Gronlie | 405/218 |
| 4,107,932 | A | 8/1978 | Cantrell | 405/220 |
| 4,126,006 | A | 11/1978 | Lewis | 405/220 |
| 4,174,187 | A | 11/1979 | Parisien | 405/221 |
| 4,260,293 | A | 4/1981 | Peterson | 405/219 |
| 4,398,849 | A | 8/1983 | Moran et al. | 405/221 |
| 4,589,800 | A | 5/1986 | Nasby, Jr. | 405/221 |
| 4,645,380 | A | 2/1987 | Hambrick et al. | 405/220 |
| 4,683,833 | A | 8/1987 | Meriwether | 114/267 |
| 4,695,195 | A | 9/1987 | Brande | 405/220 |
| 4,727,820 | A | 3/1988 | Klaus | 114/263 |
| 4,811,530 | A * | 3/1989 | Eyerly | 52/6 |
| 4,948,300 | A | 8/1990 | Bateson | 405/220 |
| 5,788,416 | A | 8/1998 | Wolgamot | 405/218 |
| 5,870,964 | A | 2/1999 | Gerber et al. | 114/263 |
| 5,915,325 | A | 6/1999 | Gerber et al. | 114/263 |
| 5,971,465 | A * | 10/1999 | Ives et al. | 296/61 |
| 6,058,633 | A * | 5/2000 | Barden | 37/468 |
| 6,179,525 | B1 | 1/2001 | Gruhn et al. | 405/219 |
| 6,217,259 | B1 | 4/2001 | Godbersen | 405/218 |
| 6,318,932 | B1 | 11/2001 | Tyler | 405/218 |
| 6,536,992 | B1 * | 3/2003 | Floe | 405/218 |
| 6,902,346 | B2 * | 6/2005 | Steig et al. | 403/322.3 |

* cited by examiner

*Primary Examiner*—Tara L. Mayo
(74) *Attorney, Agent, or Firm*—Kinney & Lange, P.A.

(57) ABSTRACT

A modular pier includes a plurality of modular pier sections. The plurality of modular pier sections includes at least a first pier section and a second pier section wherein the pier sections include a frame having a first end and a second end opposite the first end. The pier sections include a catch bar running transversely across the second end of the frame of the pier sections. The modular pier also includes latch assemblies located on the second end of the frame of the pier sections. The latch assembly of the second pier section is operable to engage the catch bar of the first pier section to connect the first pier section to the second pier section.

22 Claims, 24 Drawing Sheets

MODULAR PIER SYSTEM

CROSS-REFERENCE TO RELATED APPLICATION(S)

This application claims priority from Provisional Patent Application No. 60/486,618, filed Jul. 11, 2003 and entitled MODULAR PIER SYSTEM.

BACKGROUND OF THE INVENTION

The present invention relates to a pier, and more particularly, to a removable pier of modular construction.

Piers are commonly used in water based activities such as boating, fishing, and swimming. In some climates a removable pier system is necessary so that piers can be removed before ice forms on a lake in the winter. Various pier structures have been designed that aid in the installation and removal of the piers. Typically, these piers are formed in sections that can be connected together to form a single pier assembly. In this way, each pier section is lighter and easier to handle. In addition to this, pier sections are easier to store during the winter.

In order to install piers formed in sections, it is often necessary for the assembler to physically get into the water to connect each additional section. Because of this, most people prefer to install or remove the pier at a time when the water is at a comfortable temperature to avoid having to get into the water when it is cold. Therefore, rather than being used, the pier is often in storage for a significant portion of the spring and fall season. A pier which could be installed or removed from outside of the water would be beneficial because it could be installed very soon after the ice has melted in the spring, and also could remain in the water until ice begins to form in the fall.

While some piers have been designed to be installed from outside of the water, they are difficult to install and often require great physical exertion. For example, some piers have been designed that require that a large pier section be maneuvered horizontally and pushed out into the water. These types of piers can be difficult to install, especially when the lake bottom is composed of mud, or boulders, or if there is a lot of lake vegetation. Other piers have been designed which require the use of cranes that use ropes or chains to lower or raise pier sections from the water. In addition, latching mechanisms for holding together multiple pier sections have many problems. Some latching mechanisms are too rigid, and therefore easily break. Other latching mechanisms are complex and require tools or levers for installation. Therefore, there is a need in the art for a modular pier that can easily be installed from outside of the water, that requires little or no physical exertion, which provides a strong but flexible latching mechanism, can be easily stored, and solves other problems of current pier systems.

BRIEF SUMMARY OF THE INVENTION

The present invention is a modular pier which can be easily installed by an installer who can be either in or out of the water. The modular pier consists of a shore connection, ramp, and modular pier sections that can be attached end-to-end to form a pier of almost any length. The modular pier sections include longitudinal frame members, transverse frame members, frame runners, latch assemblies, catch bars, leg assemblies, and deck pallets.

To install the modular pier of the present invention, the owner may first install a shore connection. The shore connection consists of a catch bar or a pair of catch bars preferably running substantially horizontal to the lake and connected to posts or a frame supported by the ground, concrete, or other supporting object. To do so, the modular pier section is held in a substantially upside down position and placed such that the latch assembly of the modular pier section comes in contact with the shore connection. At this point, a shoreward end of the modular pier section is raised with respect to the shore connection, until the modular pier section is in a substantially vertical position. At this point, the modular pier section is given a slight push and released, allowing it to rotate around the catch bar until the leg assemblies come to rest on the bottom of the lake and the modular pier section lies in a substantially horizontal position. Deck pallets are then placed on top of the modular pier section. Additional modular pier sections can then be installed to the end of the first modular pier section in the same manner.

In order to allow compact storage, and pier height adjustment, specially configured leg assemblies are provided. The leg assemblies are configured of nestled tubes that can slide up and down relative to each other, and then can be locked into place by a cam mechanism when the pier is at the desired height. The leg assemblies also include a scissor brace which allows the leg assemblies to fold flat for storage, Additional leg assemblies are also provided to allow for alternate pier configurations.

The cam mechanism includes a housing with holes through which a shaft is pivotally connected. The shaft is also connected to one end of a cam arm which includes teeth opposite the shaft. The teeth extend through a slot in the adjustment tube and engage the support post to maintain the support post at the desired position relative to the adjustment tube. To adjust the height of the pier, the cam arm can be pivoted at the shaft to disengage the teeth from the support post. The support post can then be adjusted relative to the adjustment tube. Once the support post is in the desired position, the cam arm is released and the teeth allowed to engage the support post.

Another aspect of the invention is a T-section that can be installed to allow modular pier sections to branch left, right, or continue straight from the adjacent pier sections. The T-section includes longitudinal frame members, an end frame member, transverse frame members, frame runners, frame runner extensions, transverse catch bars, longitudinal catch bars, leg assemblies, and latch assemblies.

Another aspect of the invention is a curved modular pier section. The curved modular pier section is similar to the modular pier section except that the longitudinal frame members of the curved pier section are curved.

DETAILED DESCRIPTION

Figure 1:
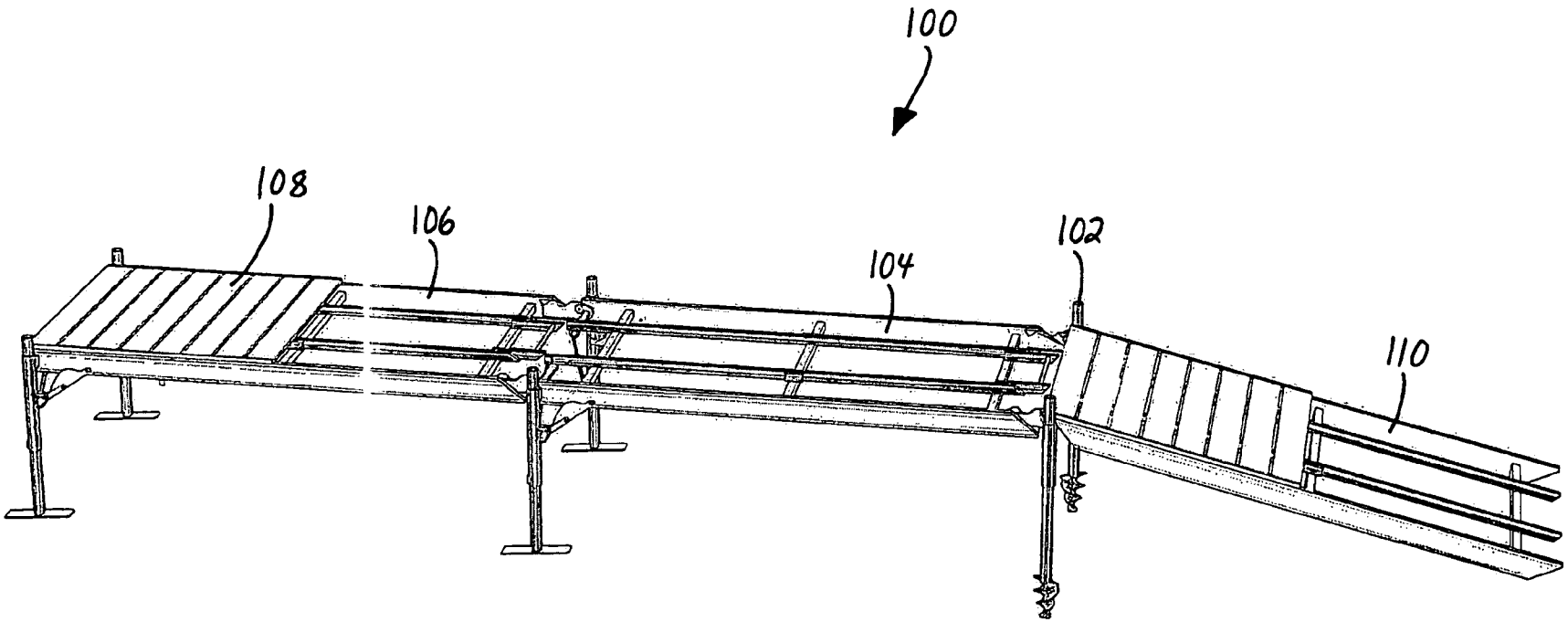
FIG. 1 shows an exemplary embodiment of a modular pier according to the present invention.

FIG. 1 shows an exemplary embodiment of modular pier 100 according to the present invention. Modular pier 100 includes shore connection 102, first modular pier section 104, second modular pier section 106, deck pallet 108, and ramp 110. Shore connection 102 connects first modular pier section 104 to a lake shore. Ramp 110 is connected to the shore connection and rests on top of the lake shore. Second modular pier section 106 is connected to a lakeward end of first modular pier section 104. Deck pallets 108 are placed on top of modular pier sections 104 and 106. Only a single deck pallet 108 is shown in FIG. 1 so that the structure of modular pier sections 104 and 106 is visible.

Shore connection 102 acts to anchor the pier to a desired location on the lake shore and provides a connecting point for the first pier section. Alternately, modular pier 100 can also be installed without a shore connection, by simply placing the shoreward end of first modular pier section 104 on the ground. In this exemplary embodiment, only two pier sections are shown. First modular pier section 104 is attached to the shore connection and extends out into the lake. Second modular pier 106 is identical to first modular pier section 104. The modular pier sections 104 and 106 are designed such that any number of pier sections can be connected in an end-to-end manner to form a pier of any desired length. As will be described, the modular design of modular pier 100 allows the pier to be easily installed or removed from the water without the assembler having to physically get into the water. However, for further versatility, modular pier 100 is also designed such that the person assembling the pier can perform the installation and removal from in the water, if they so desire.

Pier Installation

To aid in understanding the configuration of modular pier 100 of the present invention, the installation of an exemplary embodiment of modular pier 100 (as shown in FIG. 1) will now be described with reference to FIGS. 2–12. In this embodiment, installation of only two modular pier sections 104 and 106 will be described. However, it is understood that any number of additional modular pier sections can be installed in a similar manner. In addition, the embodiment describes piers having leg assemblies, but it is recognized that floating modular pier sections could also be used, as would be understood by one skilled in the art.

Figure 2:
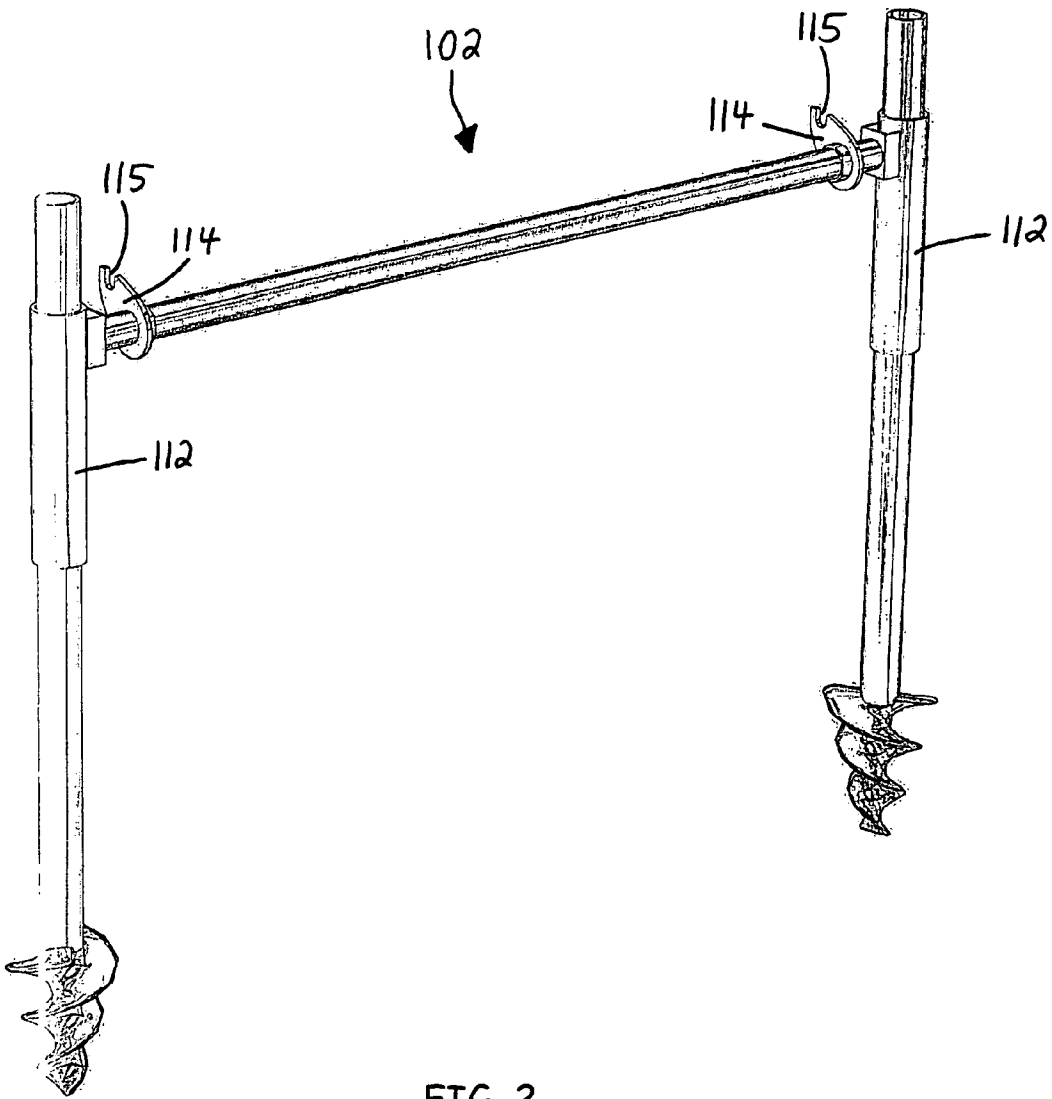
FIG. 2 is a lakeward perspective view of an exemplary shore connection of the modular pier.

FIG. 2 is a lakeward perspective view of an exemplary shore connection 102 of modular pier 100. Shore connection 102 includes support posts 112, catch bar 113, and ramp plate 114. Support posts 112 rise vertically from the ground. Horizontal catch bar 113 is typically oriented parallel to the shoreline and is connected at each end to the top of support posts 112. Ramp plates 114 are attached near both of the ends of catch bar 114. Each ramp plate 114 includes notch 115 which engages a pin of ramp 110, as will be described with reference to FIG. 7.

To begin pier installation, shore connection 102 is connected by support posts 112 to the desired location on the lake shore. Support posts 112 may be connected to the ground by any suitable means. For example, support posts 112 may be mounted, driven, or augured into the ground. It also may be desirable to removably mount shore connection 112 to the ground such that the shore connection can be removed in the winter. Once installed, shore connection 112 forms a rigid structure to which the rest of modular pier 100 will be connected.

Figure 3:
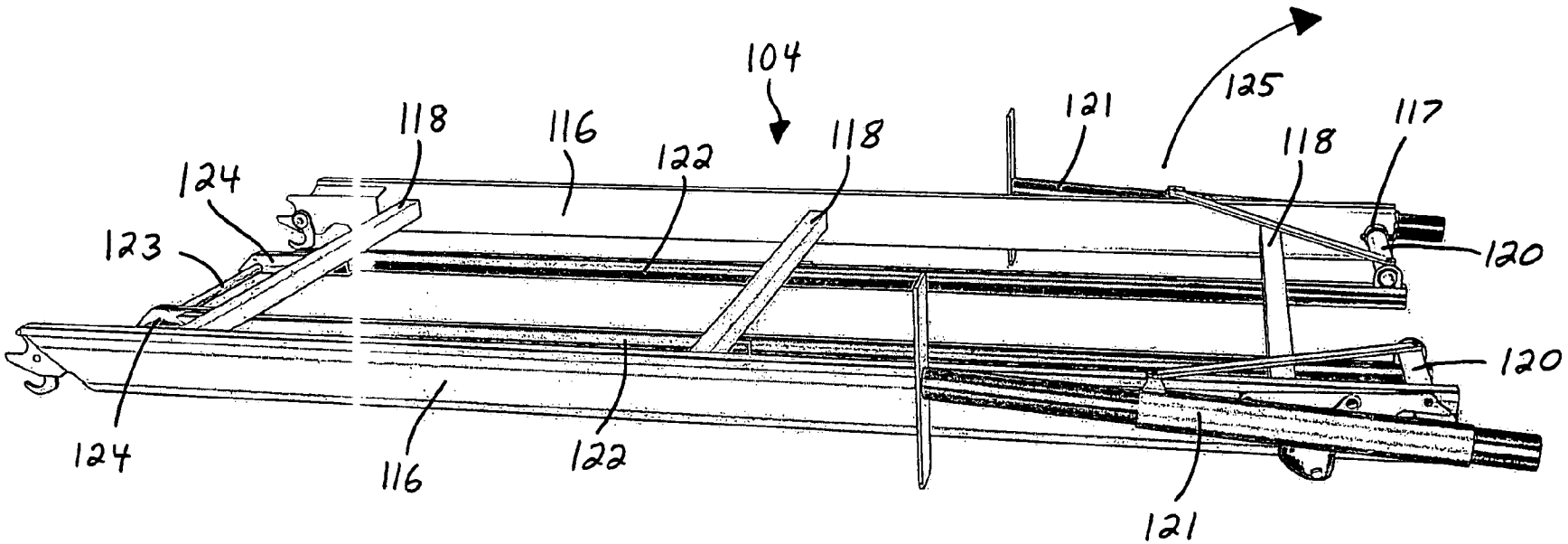
FIG. 3 is a perspective view of a first modular pier section in an upside down position and with leg assemblies in the fully retracted position.

FIG. 3 is a perspective view of first modular pier section 104 in an upside down position, with leg assemblies 121 in the fully retracted position. First modular pier section 104 includes longitudinal frame members 116 with pivot holes 117, transverse frame members 118, catch bars 120, leg assemblies 121, frame runners 122 with frame runner extensions 124, and handle 123. Longitudinal frame members 116 are rigidly connected to transverse frame members 118, which together form a rigid frame for modular pier section 104. At the lakeward ends of longitudinal frame members are pivot holes 117 through which catch bars 120 run. Catch bars 120 are attached to leg assemblies 121 and allow leg assemblies 121 to pivot at pivot holes 117. In addition to this, catch bars 117 provide a location for connecting additional modular pier sections, as will be described. Frame runners 122 run between and parallel with longitudinal frame members 116 and are attached to and supported by transverse frame members 120. Frame runners 122 perform multiple functions, including improving the structural integrity of the pier, providing a support to deck pallets 108, and acting as handles for installing and removing pier section 104. Frame runners 122 are attached at the lakeward end to catch bars 120. At the shoreward end, frame runners 122 include frame runner extensions 124 which are attached inside frame runners 122. Frame runner extensions 124 allow pier sections to be installed without frame runners 122 of the adjacent pier sections interfering with each other during installation. This structure provides support for deck pallets while also helping to guide the installation of adjacent pier sections. Frame runner extension 124 also attach to handle 123. Handle 123 provides a convenient bar to grasp when pulling pier section 104 shoreward while disassembling pier 100.

After the installation of shore connection 102, modular pier section 104 is removed from storage and placed on the ground in the upside down position. While in storage, leg assemblies 121 are kept in the fully retracted postion, as shown. To install first modular pier section 104, leg assemblies 121 must first be pivoted in the direction of arrow 125 until they lock in the fully extended position. Leg assemblies 121 will be described in further detail below. Once leg assemblies 121 have been extended, first modular pier section 104 can be installed.

Figure 4:
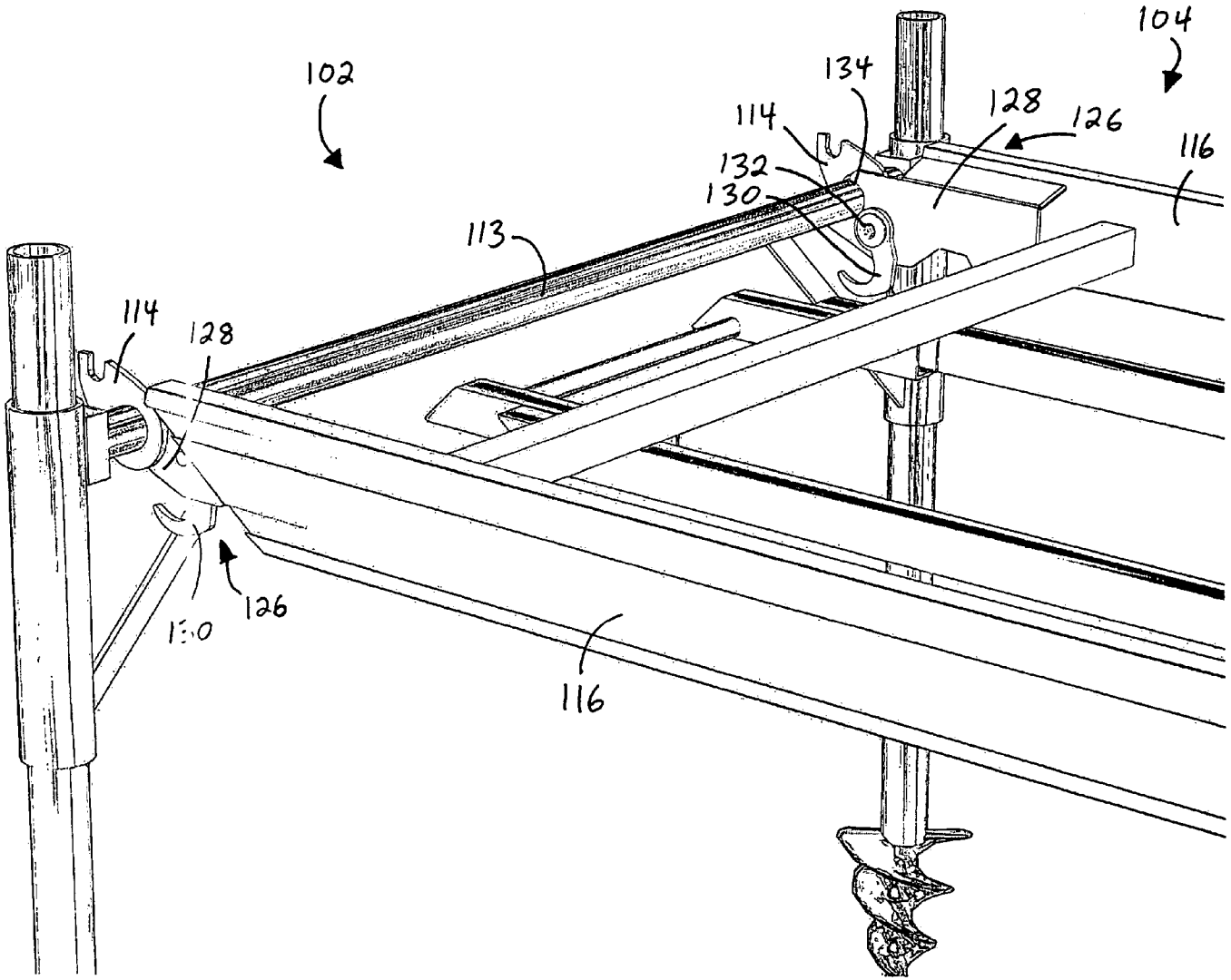
FIG. 4 is a perspective view of the first modular pier section being placed against the shore connection.

FIG. 4 is a perspective view of first modular pier section 104 being placed against shore connection 102. Shore connection 102 includes catch bar 113. Modular pier section 104 includes longitudinal frame members 116 and latch assemblies 126. Latch assemblies 126 include latch plates 128, with notch 134, and latch hooks 130. Latch plates 128 of latch assemblies 126 are rigidly attached to a shoreward end of longitudinal frame members 116. Latch hooks 130 are pivotally connected to latch plates 128 by latch pins 132. Latch pins 132 may be formed of a rod, a bolt, or any similar structure that pivotally connects latch hooks 130 to latch plates 128. Latch plates 128 include notch 134 which is configured to fit around catch bar 113 of shore connection 102.

After leg assemblies 121 of first modular pier section 104 have been extended, first modular pier section 104 is ready to be installed. To do so, the assembler carries or drags first modular pier section 104 over to the shoreward side of shore connection 102. Keeping first modular pier section 104 in the upside down and substantially horizontal position, catch bar 113 of shore connection 102 is slid into notches 134 of latch plates 128. When in this position, latch hooks 130 are pulled by gravity and hang below latch plates 128, leaving latch plates 128 open to receive catch bar 113.

Figure 5:
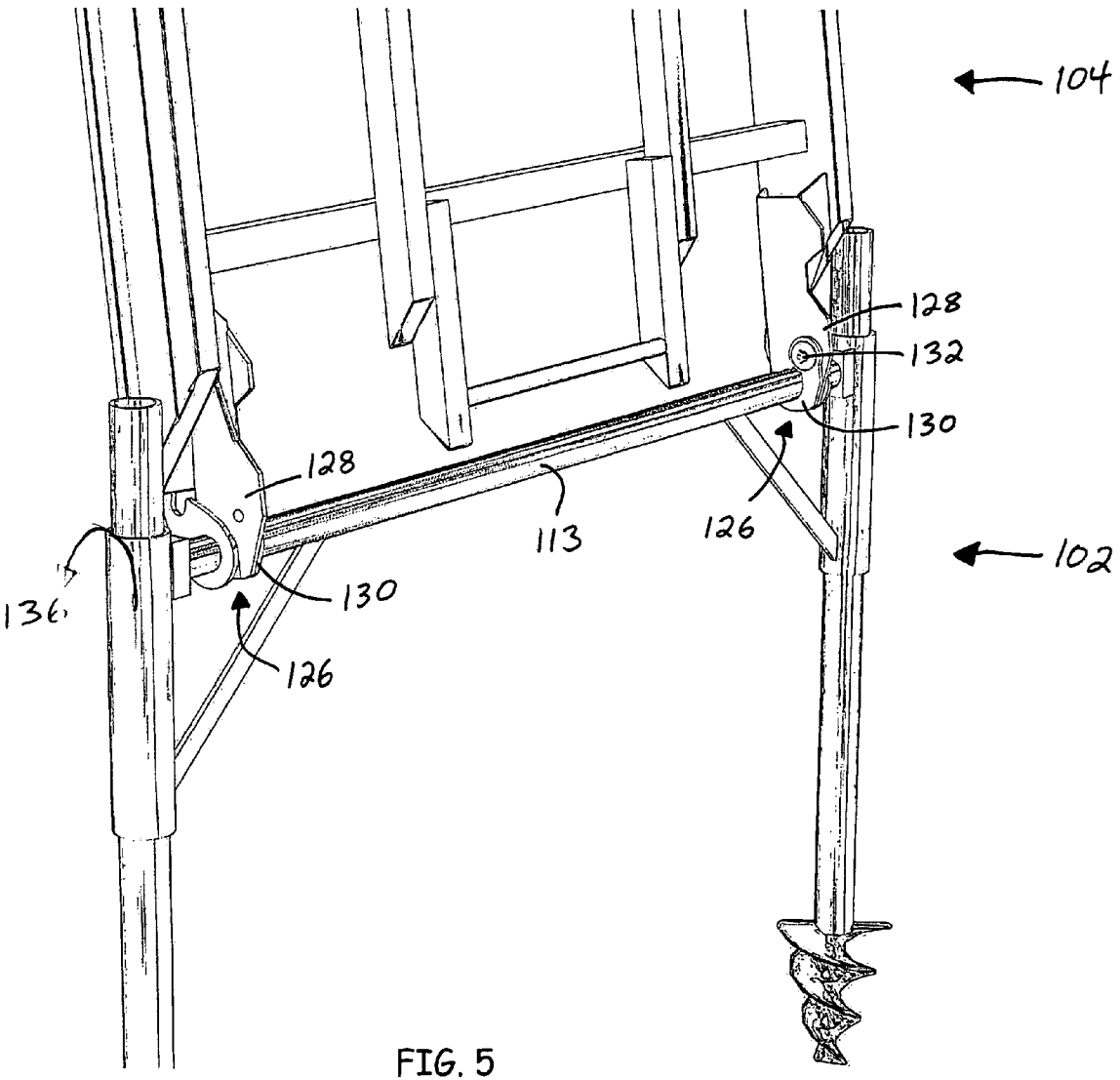
FIG. 5 is a perspective view of the first modular pier section being pivoted around a catch bar.

FIG. 5 is a perspective view of first modular pier section 104 being pivoted around catch bar 113. First modular pier section 104 includes latch assemblies 126 which include latch plate 128, latch hook 130 and latch pin 132. Shore connection 102 includes catch bar 113.

After first modular pier section 104 has been placed against shore connection 102, first modular pier section 104 is pivoted around catch bar 113 in the direction of arrow 136. To do so, the installer lifts the currently shoreward end of first modular pier section 104 until first modular pier section 104 is in a substantially vertical position, as shown in FIG. 5. As first modular pier section 104 rotates around catch bar 113, the force of gravity causes latch hooks 130 to latch around catch bar 113. Latch hooks 130 are configured to fit around catch bar 113 such that catch bar 113 is locked between latch plate 128 and latch hook 130. At this point, first modular pier section 104 is given a gentle push toward the lake, and then let go. First modular pier section 104 is pulled by the force of gravity, and rotates around catch bar 113 until leg assemblies 121 (not shown in FIG. 5) come to rest on the lake bottom. This results in first modular pier section 104 being attached to shore connection 102 in the right-side-up and substantially horizontal position of FIG. 6.

In the case where the water is very shallow, it may be desirable to slowly lower first modular pier section 104 into the water by standing next to shore connection 102 and gently lowering first modular pier section 104 into the water. Alternatively, a device such as a rope, chain, pole, or combination of these could be used to slow the descent of modular pier section 104.

Figure 6:
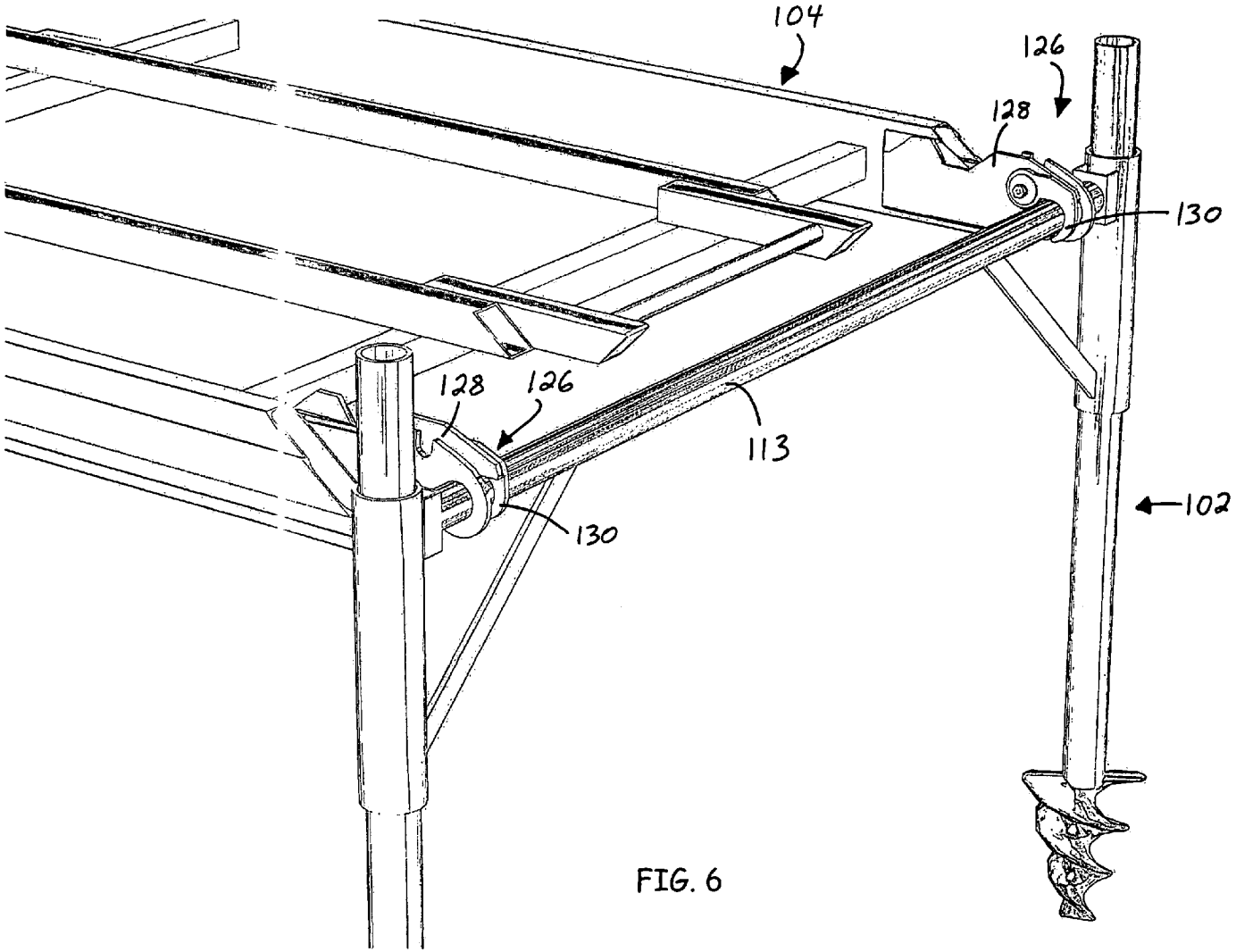
FIG. 6 is a perspective view of the first modular pier section installed with latch hooks engaging a catch bar of the shore connection.

FIG. 6 is a perspective view of first modular pier section 104 installed with latch hooks 130 engaging catch bar 113 of shore connection 102. First modular pier section 104 includes latch assemblies 126 which include latch plates 128 and latch hooks 130. Shore connection 102 includes catch bar 113. With first modular pier section 104 now installed, latch hook 130 is held by the force of gravity in the latched position and firmly connects first modular pier section 104 to shore connection 102.

The configuration of latch assemblies 126 provide many benefits. As already described, the latch assemblies make installation of a dock section very fast and easy. As first modular pier section 104 is installed, latch assembly 126 automatically latches on to catch bar 113 due to the force of gravity. Because of this, there are no additional steps needed to connect first modular pier section 104 to shore connection 102. Latch assemblies 126 provide a strong, reliable connection. As a further benefit, latch assemblies 126 form a pivotal connection that allows first modular pier section 104 to pivot around catch bar 113 during and after installation. This is beneficial for multiple reasons. For example, if the assembler forgets to extend leg assemblies 121 prior to installation, or has not adjusted leg assemblies to the proper height, first modular pier section 104 will not be damaged if it swings below the horizontal position. In addition, the pivotal connection allows first modular pier section 104 to pivot if it is subjected to very large waves, rather than being damaged.

Figure 7:
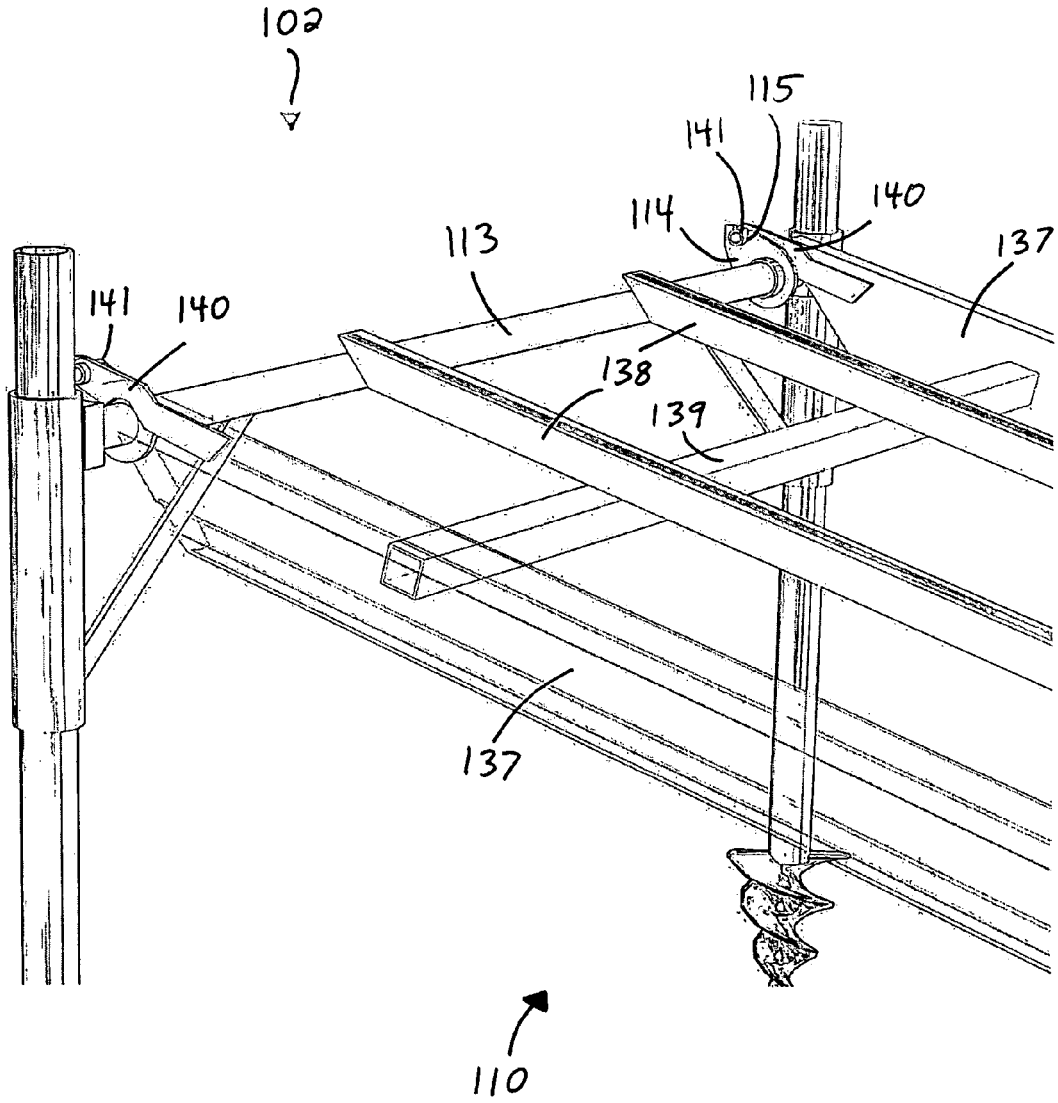
FIG. 7 is a perspective view of a ramp after being installed onto the shore connection.

FIG. 7 is a perspective view of ramp 110 after being installed onto shore connection 102. Ramp 110 includes longitudinal frame members 137, frame runners 138, transverse frame members 139, plates 140, and pins 141. The design of the frame of ramp 110 is similar to the frame of pier section 104. Transverse frame members 139 are attached at each end to longitudinal frame members 137. Frame runners 138 are attached to transverse frame members 139 and run between and parallel to longitudinal frame members 137. At the lakeward end of longitudinal frame members 137 are end plates 140 connected to pins 141.

Installation of ramp 10 will typically be performed after installation of modular pier section 104, but can be installed at any time after installation of shore connection 102. Modular pier section 104 is not shown in FIG. 7 to allow the connection of ramp 110 to shore connection 102 to be more easily understood. Installation of ramp 110 involves lifting the shoreward end of ramp section, and placing pin 141 in notch 115 of ramp plate 114. In this way, ramp 110 is securely held in place by plate 114 and pin 141 at one end, and rests against the shore at the other end. After the installation of ramp 110, deck pallets are installed on top of ramp 110 in the same way as installed on a modular pier section, as described below. In this way, ramp 110 provides a strong and sturdy surface for accessing pier 100.

Figure 8:
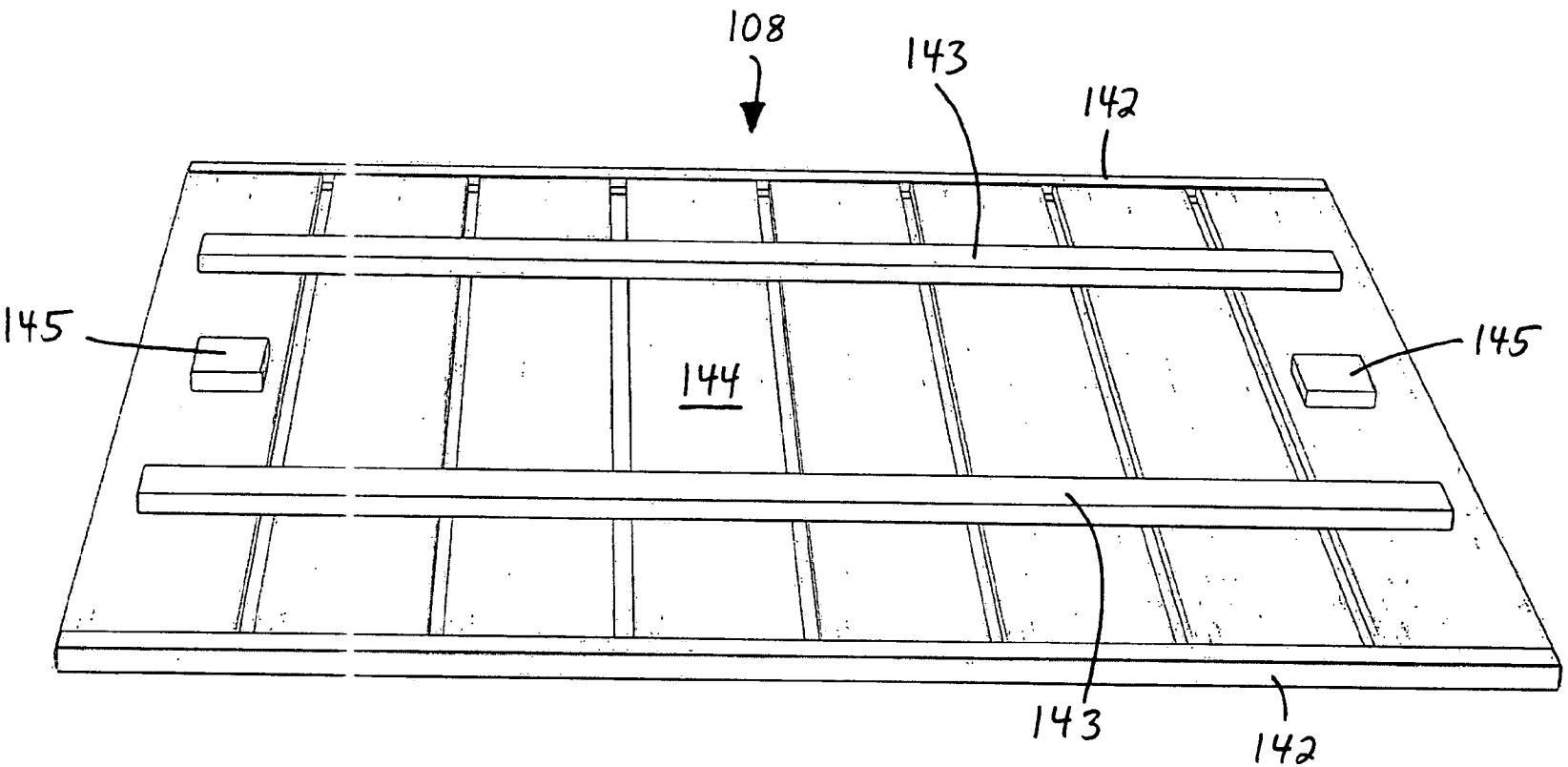
FIG. 8 is a perspective view of the bottom of a deck pallet.

FIG. 8 is a perspective view of the bottom of deck pallet 108. Deck pallet 108 includes outer longitudinal members 142, inner longitudinal members 143, deck planks 144, and blocks 145. A plurality of deck planks 144 are attached to outer longitudinal members 142 at both ends of deck planks 144 and to the inner longitudinal member 143. Inner longitudinal members 143 are spaced to fit adjacent to frame runners 122 when installed on modular pier section 104 to keep deck pallet 108 from moving sideways. In addition, inner longitudinal members provide additional weight bearing strength and stability to deck pallets 108. Blocks 145 are placed such that they will be adjacent handle 123 when installed on modular pier section 104 to prevent shoreward longitudinal movement of deck pallet 108. It is recognized that only a single block is necessary to accomplish this function, but having two blocks allows deck pallet 145 to be installed in either longitudinal direction and still have one of blocks 145 adjacent to handle 123. Deck pallets 108 are designed to be placed on top of all modular pier sections (with slight modifications for curved pier sections) and ramp 110 to provide a firm walking surface. Additional longitudinal support can also be provided by installing pallet stops, such as blocks or "L" shaped brackets, on the sides of frame runners 122. The pallet stops are installed to abut the end of inner longitudinal members 143, at approximately the center and lakeward end of frame runners 122.

In an alternate embodiment, deck pallet 108 includes at least one notch in inner longitudinal members 143. In this embodiment, at least one frame runner 122 of first modular pier section 104 (for example) includes at least one pin, attached such as by welding, designed to mate with the notch in inner longitudinal members 143. In this embodiment, blocks 145 would not be necessary. The pin can be located at any point along frame runners 122, and the notch located accordingly in inner longitudinal members 143. In the preferred embodiment, one notch is placed on the interior side of each of the interior longitudinal members 143, such that deck pallet 108 can be installed in either longitudinal orientation. The pin and notch system prevents deck pallet 108 from moving longitudinally (or transversely), yet allows deck pallets to be easily lifted and removed from modular pier 100.

Figure 9:
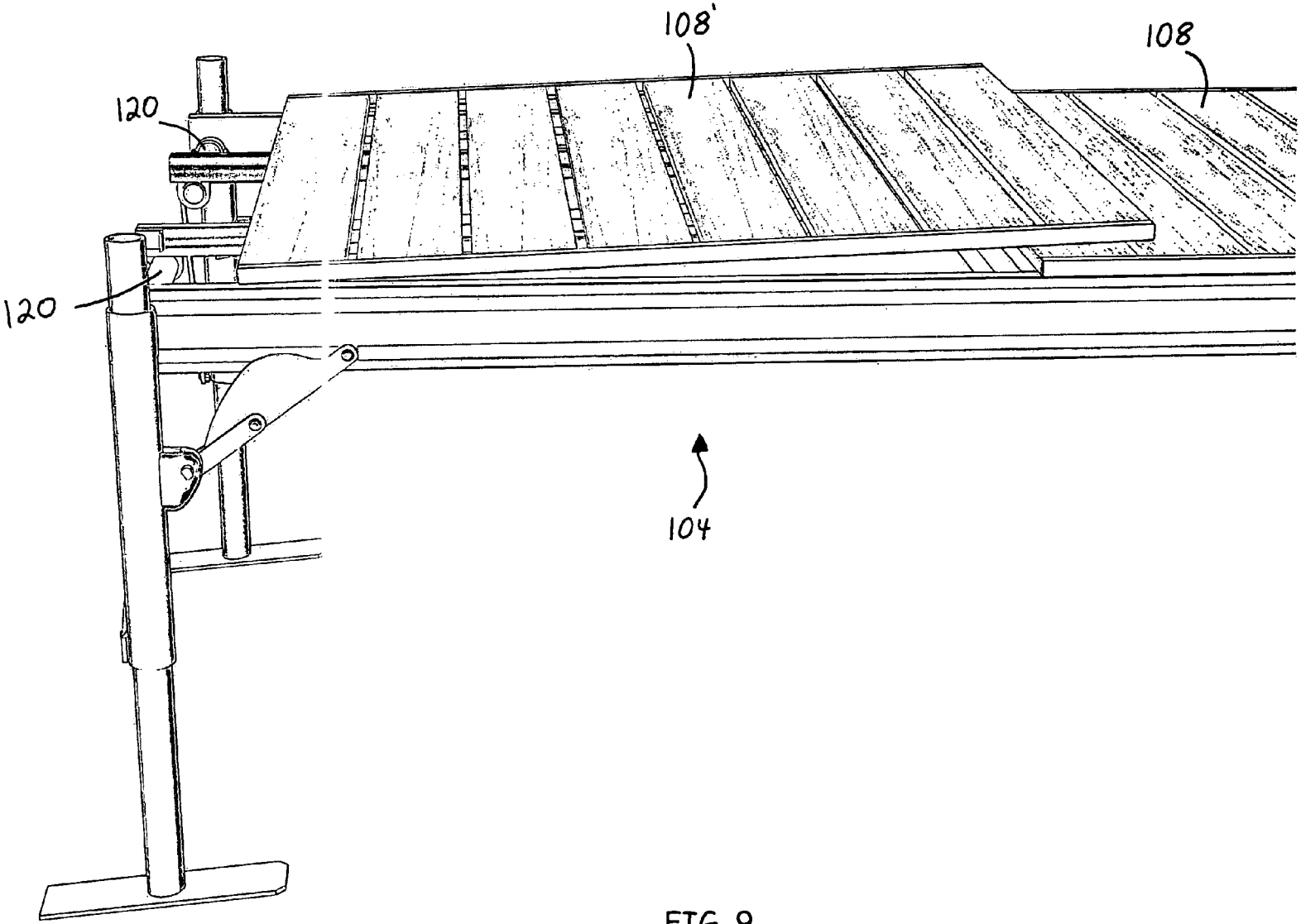
FIG. 9 is a perspective view of a first modular pier section with a second deck pallet overlapping a first deck pallet.

FIG. 9 is a perspective view of first modular pier section 104 with second deck pallet 108' overlapping first deck pallet 108. First modular pier section 104 includes catch bars 120. First deck pallet 108 is placed on top of a portion of first modular pier section 104. Second deck pallet 108' is also placed on top of an adjacent portion of first modular pier section 104. To allow additional pier sections to be added to the end of first modular pier section 104, second deck pallet 108' can be pulled up and back so that it overlaps first deck pallet 108. In this way, the assembler can easily access catch bars 120 of first modular pier section 104 for the installation or removal of additional pier sections.

Once first modular pier section 104 is in position, second modular pier section 106 can easily be attached without the assembler needing to get into the water.

Figure 10:
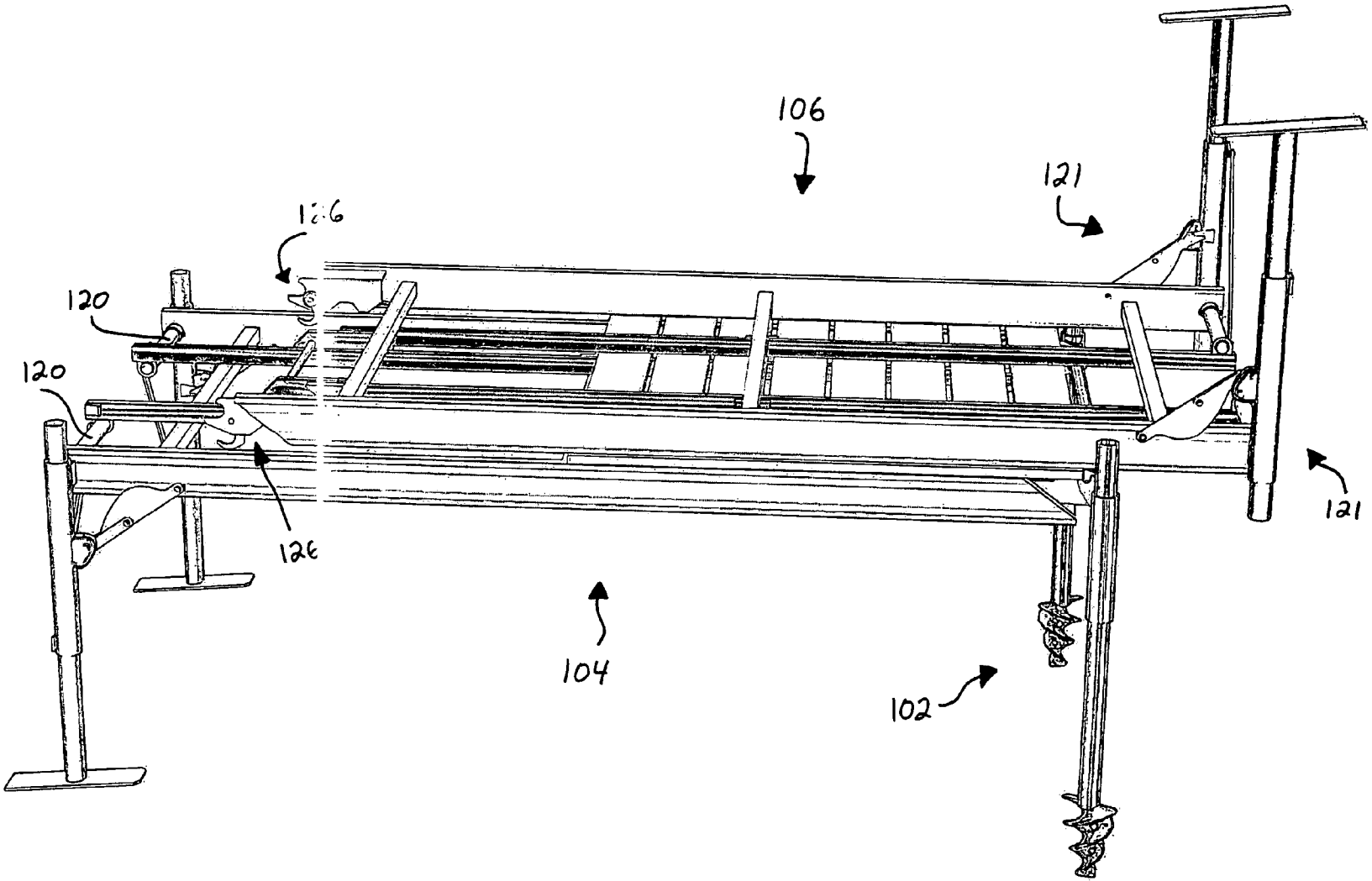
FIG. 10 is a perspective view of the first modular pier section with a second modular pier section placed on top of the first modular pier section and being prepared for installation.

FIG. 10 is a perspective view of first modular pier section 104 with second modular pier section 106 placed on top of first modular pier section 104 and being prepared for installation. First modular pier section 104 is shown after being installed to shore connection 102. (Note that in the preferred installation method, second deck pallet 108' is not installed, as shown. However, in an alternate embodiment, second deck pallet 108' could be installed such that it overlaps first deck pallet 108, as shown in FIG. 9.) Second modular pier section 106 is identical to first modular pier section 104. For simplicity, the same reference numerals will be used to refer to the same parts on second modular pier section 106 as have been described for first modular pier section 106. Specifically, second modular pier section 106 includes leg assemblies 121 and latch assemblies 126 at opposite ends of second modular pier section 106.

With the installation of first modular pier section 104 complete, and the deck pallet or pallets in place, second modular pier section 106 can now be installed. Second modular pier section 106 must first be taken out of storage and carried to the pier. Second modular pier section 106 can be placed on top of first modular pier section upside down with latch assemblies 126 facing toward catch bars 120 of first modular pier section 104. Leg assemblies 121 are then placed in the fully extended position. FIG. 10 shows the desired setup.

Figure 11:
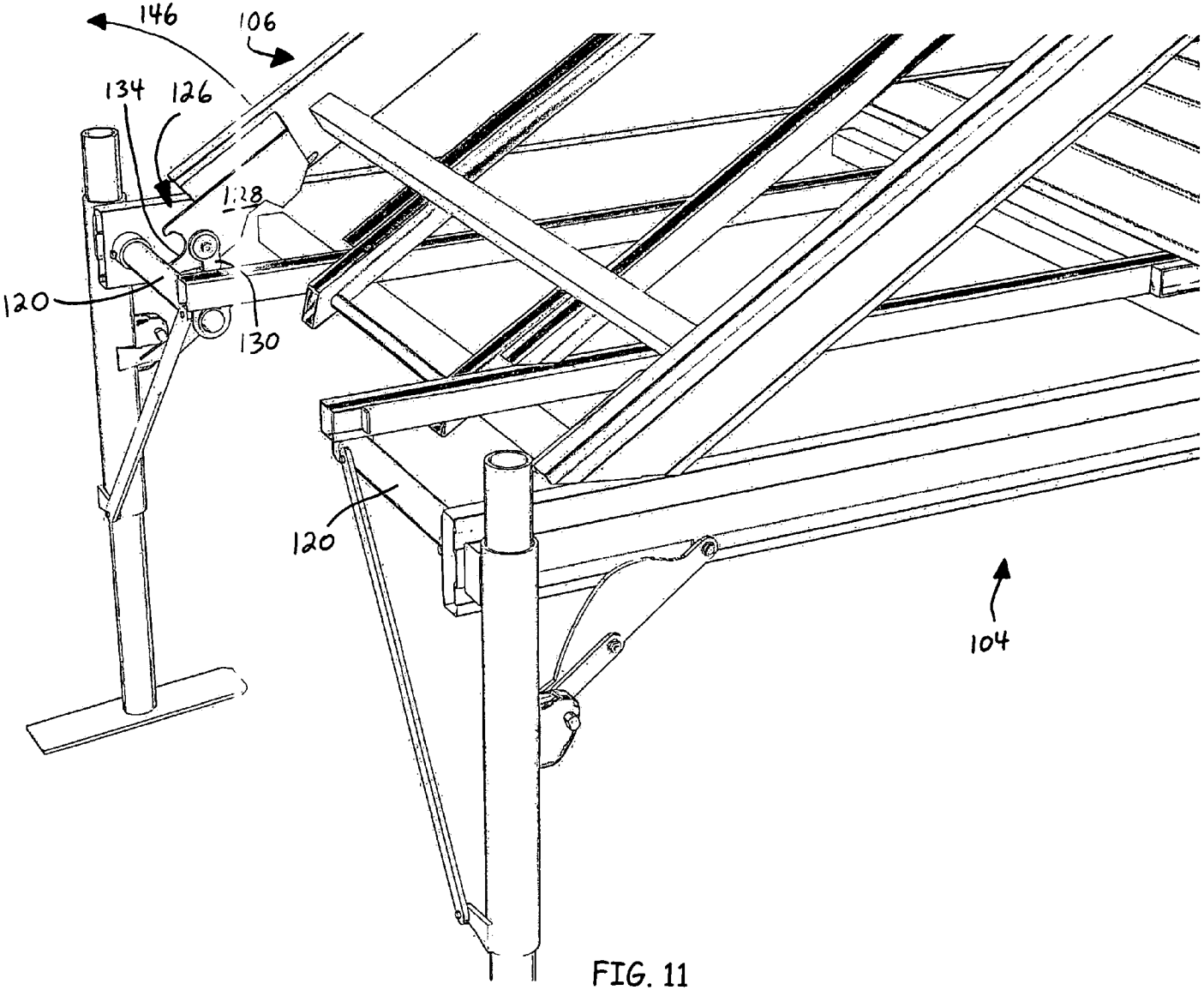
FIG. 11 is a perspective view of the second modular pier section placed against the catch bars of the first modular pier section.

FIG. 11 is a perspective view of second modular pier section 106 placed against catch bars 120 of first modular pier section 104. Second modular pier section 106 includes latch assemblies 126 which include latch plate 128 with notch 134, and latch hook 130.

To attach second modular pier section 106 to first modular pier section 104, second modular pier section 106 is placed upside down on top of first modular pier section 104 (as was shown in FIG. 10). Next, by lifting slightly on the currently shoreward end of second modular pier section 106, latch assemblies 126 are lowered toward catch bars 120. Second modular pier section 106 is then carried or slid lakeward across first modular pier section 104 such that catch bars 120 slide into notches 134 of latch plates 128.

Once catch bars 120 have been slid into notch 134, second modular pier section 106 is rotated around catch bars 120 in the direction of arrow 146 until second modular pier section 106 is in a substantially vertical position. At this point, second modular pier section 106 is gently pushed lakeward and released, causing second modular pier section 106 to continue rotating around catch bars 120 until leg assemblies 126 (not shown in FIG. 11) come to rest on the lake bottom and second modular pier section 106 is in the substantially horizontal position shown in FIG. 12.

As second modular pier section 106 is rotated in the direction of arrow 146, latch hook 130 is pulled downward by the force of gravity until latch hook 130 latches onto catch bars 120 forming a pivotal connection between first modular pier section 104 and second modular pier section 106.

If the assembler desires to install modular pier section 106 by getting into the water, this method of assembly is also possible. To install modular pier section 106 from inside the water, pier section 106 is first carried right side up into the water where notch 134 of latch plate 128 is maneuvered to engage catch bars 120. Hooks 130 are then manually rotated to lock latch plate 128 onto catch bar 120.

Figure 12:
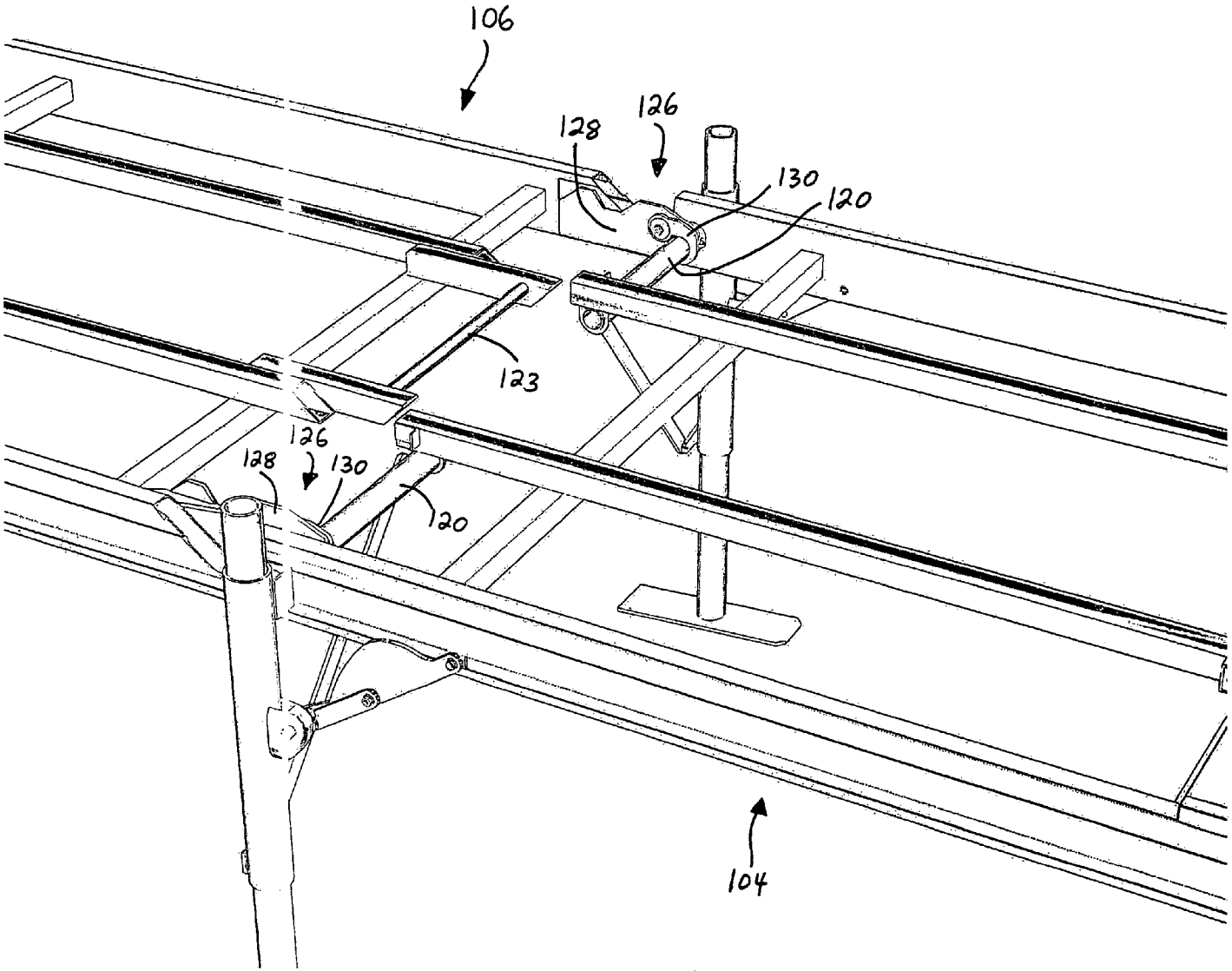
FIG. 12 is a perspective view of the first modular pier section and the second modular pier section connected together.

FIG. 12 is a perspective view of first modular pier section 104 and second modular pier section 106 connected together. First modular pier section 104 includes catch bars 120. Second modular pier section 106 includes latch assemblies 126, which include latch plate 128 and latch hook 130. Catch bars 120 of first modular pier section 104 is pivotally connected to second modular pier section 106 by latch assemblies 126. As previously described, latch assemblies 126 comprised of latch plate 128 and latch hook 130 form a pivotal connection to catch bars 120. The pivotal connection is not only beneficial for ease of installation, but also to prevent damage from occurring to the pier sections either during or after installation. The force of gravity on latch hooks 130 prevents latch hooks 130 from disengaging from catch bars 120 unless they are intentionally unlatched by the assembler. At this point, deck pallets 108 can be placed over second modular pier section 106 to form a sturdy walking surface.

Pier Removal

Removal of modular pier 100 from the water is also greatly simplified by the design of modular pier 100 of the present invention. With respect to FIG. 12, second modular pier section 106 can be removed by following the following steps. First, deck pallets 108 (not shown) are removed from second modular pier section 106. Next, latch hooks 130 are lifted up, such that they disengage from catch bars 120. The disassembler then grasps handle 123 and pushes second modular pier section 106 slightly lakeward to disengage catch bars 120 from a portion of latch plates 128. At this point, the disassembler pulls second modular pier section up and then backwards onto first modular pier section 104. The disassembler then maneuvers second modular pier section 106 such that it can be easily turned upside down (for example, such that second modular pier section 106 is above and perpendicular to first modular pier section 104), retracts leg assemblies 121 (not shown), lifts up second modular pier section 106, and carries it into storage. These steps are then repeated until the entire modular pier has been removed. Shore connection 102 may remain on the shore, or can also be removed and stored during the winter.

T-Section

Figure 13:
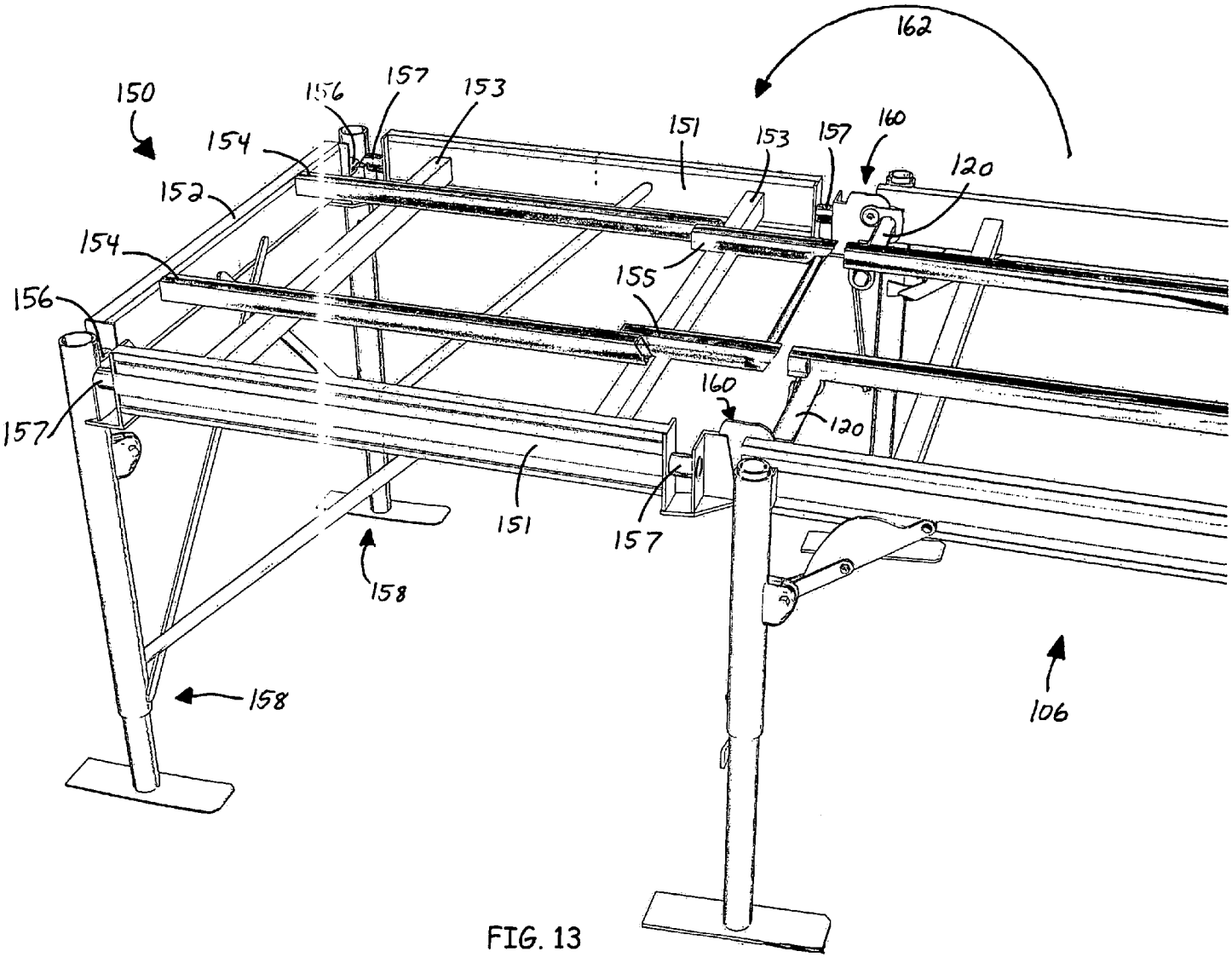
FIG. 13 is a perspective view of a T-section of the present invention.

FIG. 13 is a perspective view of T-section 150 of the present invention. T-section 150 includes longitudinal frame members 151, end frame member 152, transverse frame members 153, frame runners 154, frame runner extensions 155, transverse catch bars 156, longitudinal catch bars 157, leg assemblies 158, and latch assemblies 160. Second modular pier section 106 includes catch bars 120. Longitudinal frame members 151 and end frame member 152 form an outer frame for T-section 150. Connected to the outer frame is an inner frame including transverse frame members 153, frame runners 154, and frame runner extensions 155. Transverse catch bars 156 are attached to each end of end frame member 152. Upper portions of leg assemblies 158 are also attached to transverse catch bars 156. Longitudinal catch bars 157 also attach to leg assemblies 158 and to longitudinal frame members 151. Latch assemblies 160 of T-section 150 are identical to latch assemblies 126 of first and second modular pier sections 104 and 106 and allow T-sections to be installed in the same way as additional modular pier sections are installed to first and second modular pier sections 104 and 106.

For further versatility, the present invention includes T-section 150 which allows modular pier sections to be added to both the lakeward end of the pier, and also at right angles to the pier. In this way, modular pier 100 can be installed in many different configurations. For example, T-section 150 is shown in FIG. 13 after having been attached to the lakeward end of second modular pier section 106.

To connect T-section 150 to a modular pier section (such as second modular pier section 106) a similar procedure is followed as in the installation of first or second modular pier sections 104 or 106. First, T-section 150 is placed upside down on top of second modular pier section 106, such that latch assemblies 160 point in a lakeward direction. Then, the currently shoreward end of T-section 150 is raised slightly causing latch assemblies 160 to lower toward catch bar 120. T-section 150 is then slid, rocked, walked, or maneuvered lakeward until latch assemblies 160 come in contact with catch bar 120 of modular pier section 106. At this point, the currently shoreward end of T-section 150 is rotated in the direction of arrow 162 until T-section 150 is in the substantially horizontal position. When T-section 150 is in the substantially horizontal position, the force of gravity causes latch assemblies to engage catch bar 120 of modular pier section 106.

T-section 150 allows the assembler to install modular pier sections to the left, right, or at the end of T-section 150. The name "T-section" comes from the fact that T-section 150 allows additional pier sections to be added to the left and right of T-section 150, allowing the formation of a modular pier with a "T" shape. It is recognized that the present invention is not limited to modular piers of a linear shape or a "T" shape. Many other configurations are possible including platform configurations (as will be described) as well as "U" shaped, "L" shaped, and square shaped piers. The number of possible configurations is limited only by the number of modular pier sections used, the number of T-sections used, and the imagination of the assembler.

The process of installing additional modular pier sections to T-section 150 is nearly identical to the process of installing any of the previously described pier sections except that pier sections that are installed to the sides of T-section 150 are installed onto longitudinal catch bars 157 rather than transverse catch bars 120 or 156. In addition to this, deck pallets 108 (not shown) must be left off of T-section 150 until the installation of additional pier sections has been completed to allow access to short catch bars 156 as needed. To provide a place for the assembler to stand, an optional platform can be placed on top of frame members (151, 152, 153) and/or frame runners. Other than these minor differences, the process of installing additional pier sections is the same as has been previously described and should be easily understood by one skilled in the art.

Platform Configuration

Figure 14:
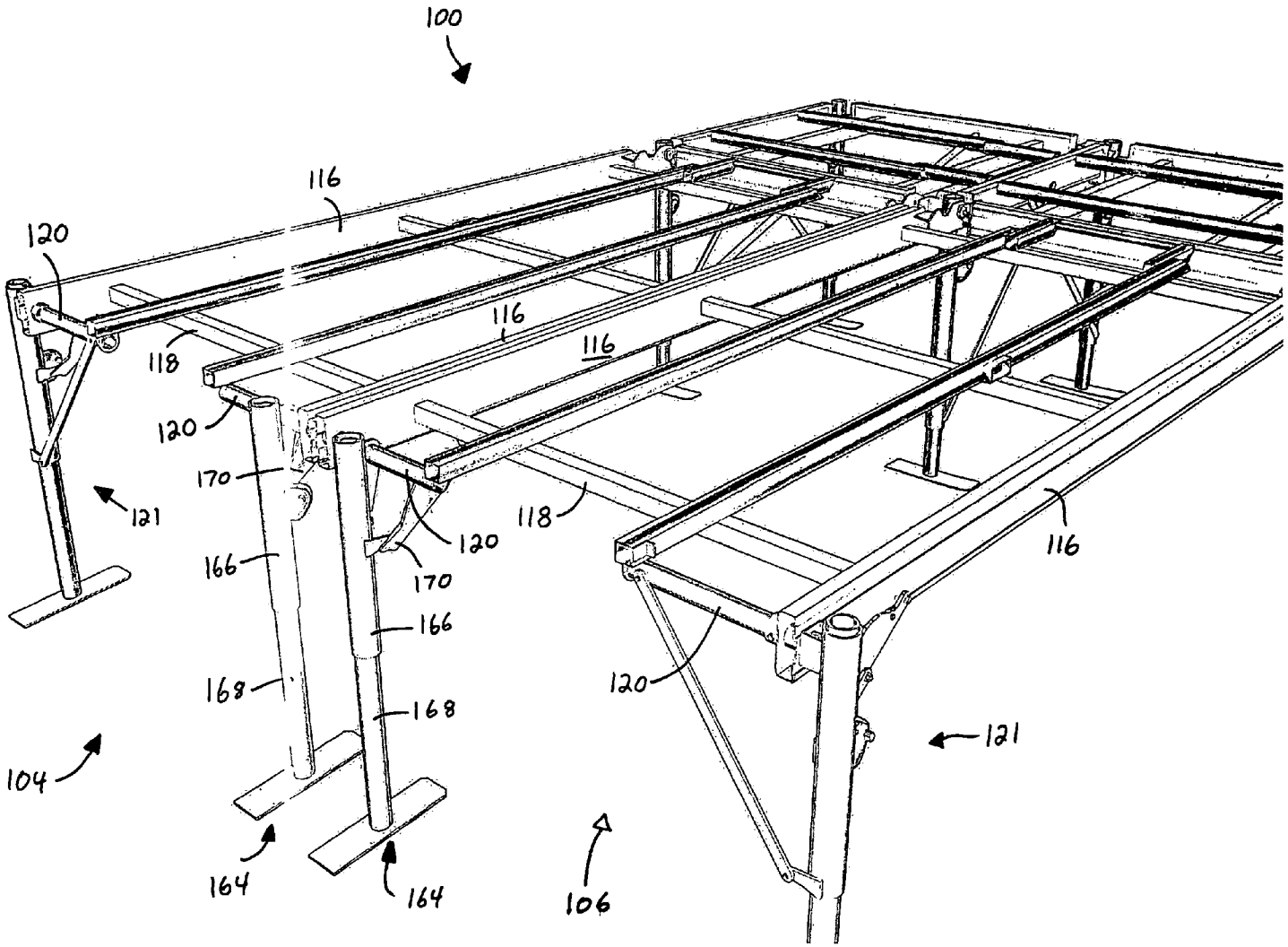
FIG. 14 is a perspective view of the modular pier arranged in a platform configuration.

FIG. 14 is a perspective view of modular pier 100 arranged in a platform configuration. Modular pier 100 includes first modular pier section 104 and second modular pier section 106. First and second modular pier sections 104 and 106 include longitudinal frame members 116, leg assemblies 121, platform assemblies 164, and catch bars 120. Platform leg assemblies 164 include adjustment tube 166, secondary adjustment tube and pad 168, and scissor brace 170. Adjustment tube 166 is attached to catch bar 120 at an upper end and accepts secondary adjustment tube 168 at the other. A portion of scissor brace 170 is connected to a middle-portion of adjustment tube 166. The other end of scissor brace 170 connects to transverse frame member 118. Scissor brace 170 allows platform leg assemblies 164 to be retracted and extended in the same way as typical leg assemblies 121.

In some situations it may be desirable to configure modular pier sections in a platform configuration to increase the width of modular pier 100. To do this, modular pier sections are installed side-by-side to form a pier of two or more times the width of an individual pier section. One way of installing a platform configuration would be by first installing two T-sections one to the other. Then, first and second modular pier sections 104 and 106 could be installed side-by-side to the adjacent T-sections.

However, there is a problem that arises when installing pier sections in a platform configuration. Typical leg assemblies 121 are installed on the sides of first and second modular pier sections 104 and 106, which interfere with the side-by-side installation of first and second modular pier sections 104 and 106. Because of this, platform leg assemblies 164 are provided that are installed on the inner side of longitudinal frame members 116 rather than the outer side. Typical leg assemblies 121 can be removed from the desired side of modular pier section 104 or 106 and a platform leg assembly installed in its place.

Figure 15:
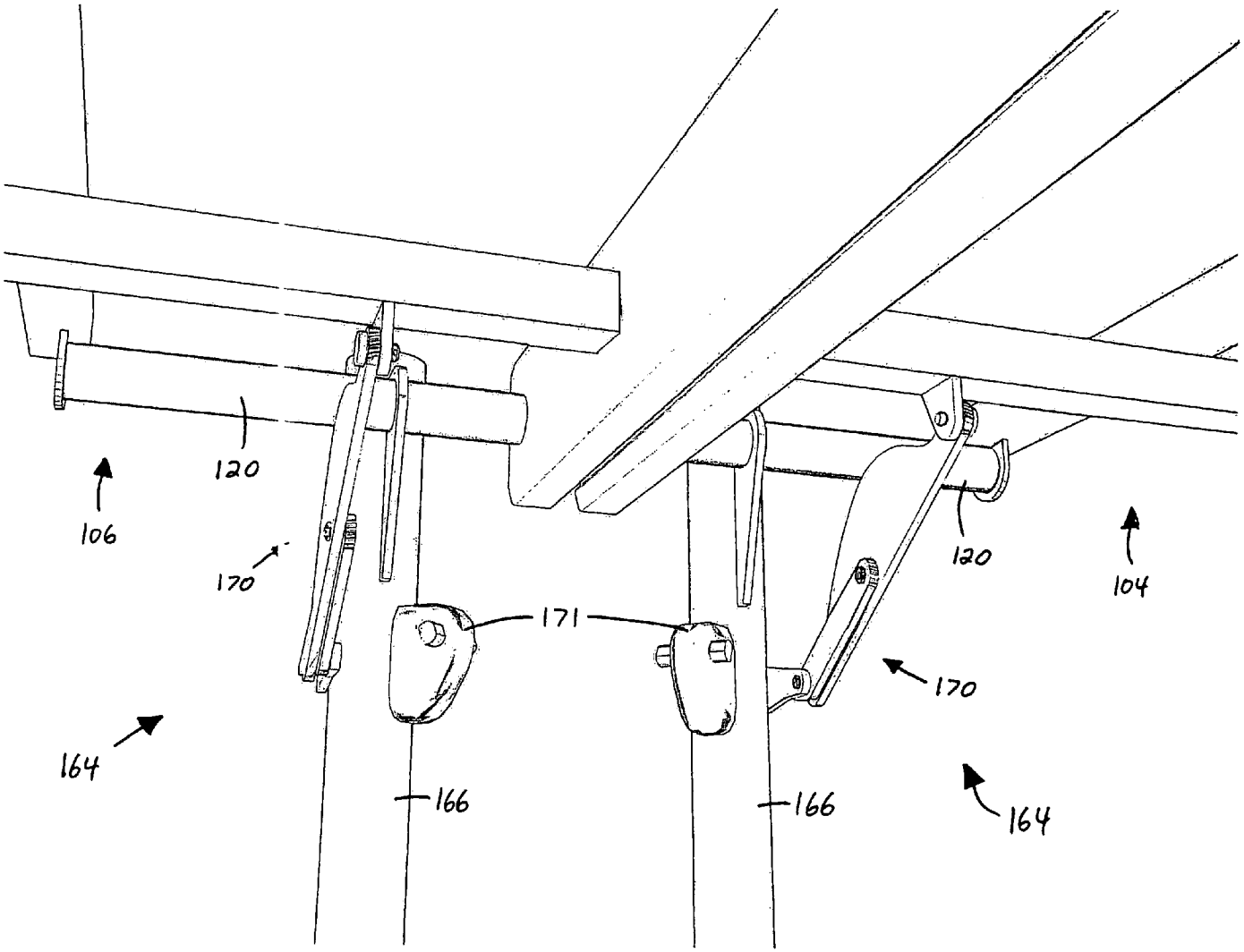
FIG. 15 is a lakeward perspective view of platform leg assemblies viewed from below first and second modular pier sections.

FIG. 15 is a lakeward perspective view of platform leg assemblies 164 viewed from below pier sections 104 and 106. Platform leg assemblies 164 include adjustment tube 166, scissor brace 170, and cam mechanism 171. The operation of scissor brace 170 and cam mechanism 171 will be further described with reference to FIGS. 18-20.

Curved Pier Section

Figure 16:
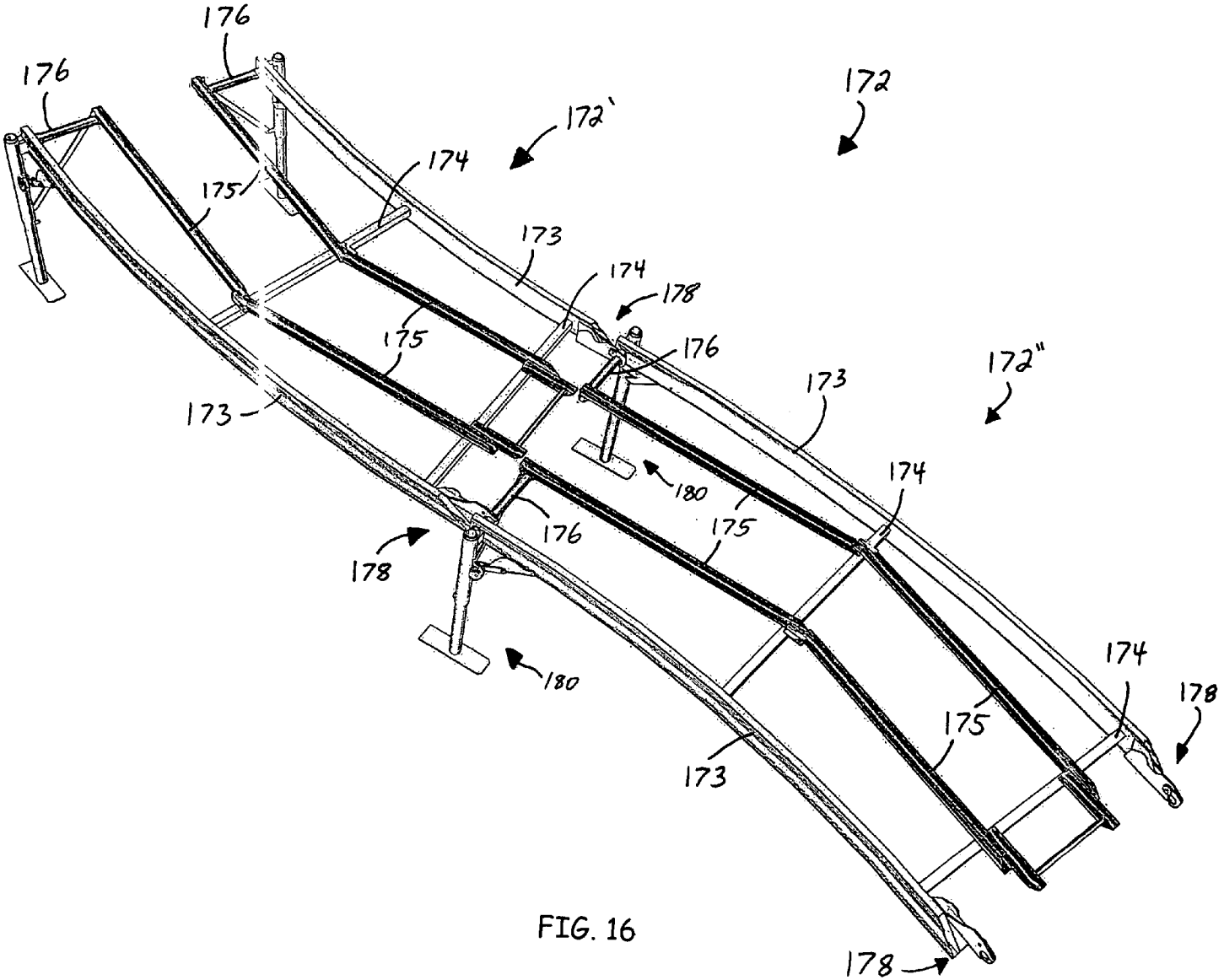
FIG. 16 is a top view of curved pier sections of the present invention.

FIG. 16 is a top view of curved pier sections 172 of the present invention, which includes curved pier sections 172' and 172". Curved pier sections 172 include longitudinal frame members 173, transverse frame members 174, frame runners 175, catch bars 176, latch assemblies 178, and leg assemblies 180. Curved pier sections 172 are similar to first and second modular pier sections 104 and 106 except that longitudinal frame members 173 have been curved and frame runners 175 have been angled accordingly. Curved pier sections 172 provide further flexibility in the configuration of a modular pier in that they allow additional shapes such as a semi-circle to be formed. It is recognized that a curved pier section could be formed with an arc of virtually any angle, but would most preferably be between about 10 and 90 degrees. Since curved pier sections 172 are very similar to first and second modular pier sections 104 and 106, installation of curved pier sections 172, or of additional pier sections onto curved pier sections 172, will be easily understood by a person skilled in the art.

Figure 17:
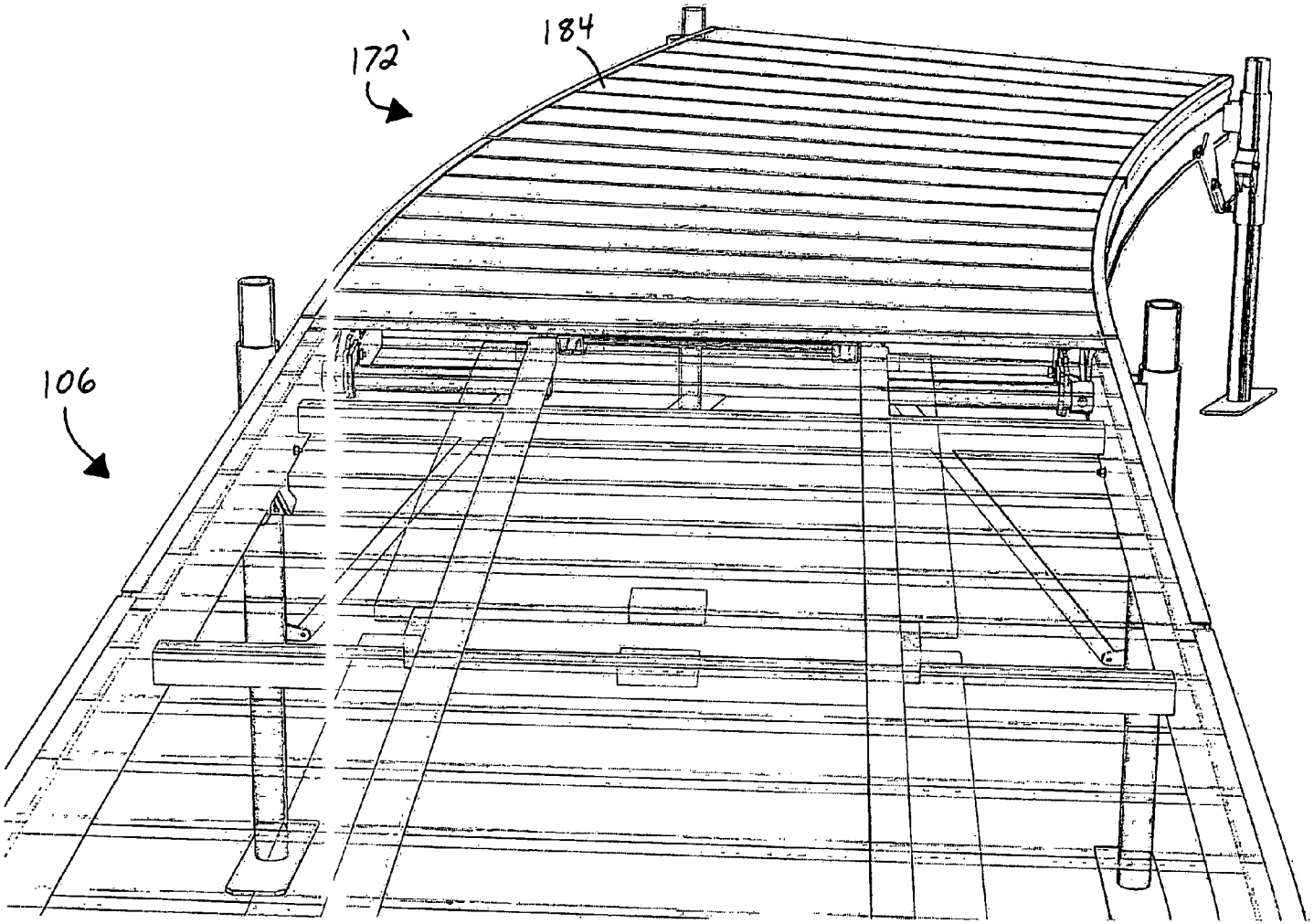
FIG. 17 is a perspective view of a curved pier section including curved deck pallets attached to the second modular pier section.

FIG. 17 is a perspective view of curved pier section 172' including curved deck pallets 184 attached to modular pier section 106. Curved deck pallets 184 are placed on top of curved pier section 172 and provide a sturdy walking surface. Curved deck pallets 184 are the same as deck pallets 108 described above, except that curved deck pallets 184 have been curved to fit the shape of curved pier section 172.

In addition to curved pier sections 172, it is also understood that other shapes could be used in the formation of a modular pier section. For example, the frame of a modular pier section could be constructed in shapes such as a parallelogram, pyramid, trapezoid, pentagon, or any other desirable shape, allowing for a wide variety of modular pier configurations.

Leg Assembly

Figure 18:
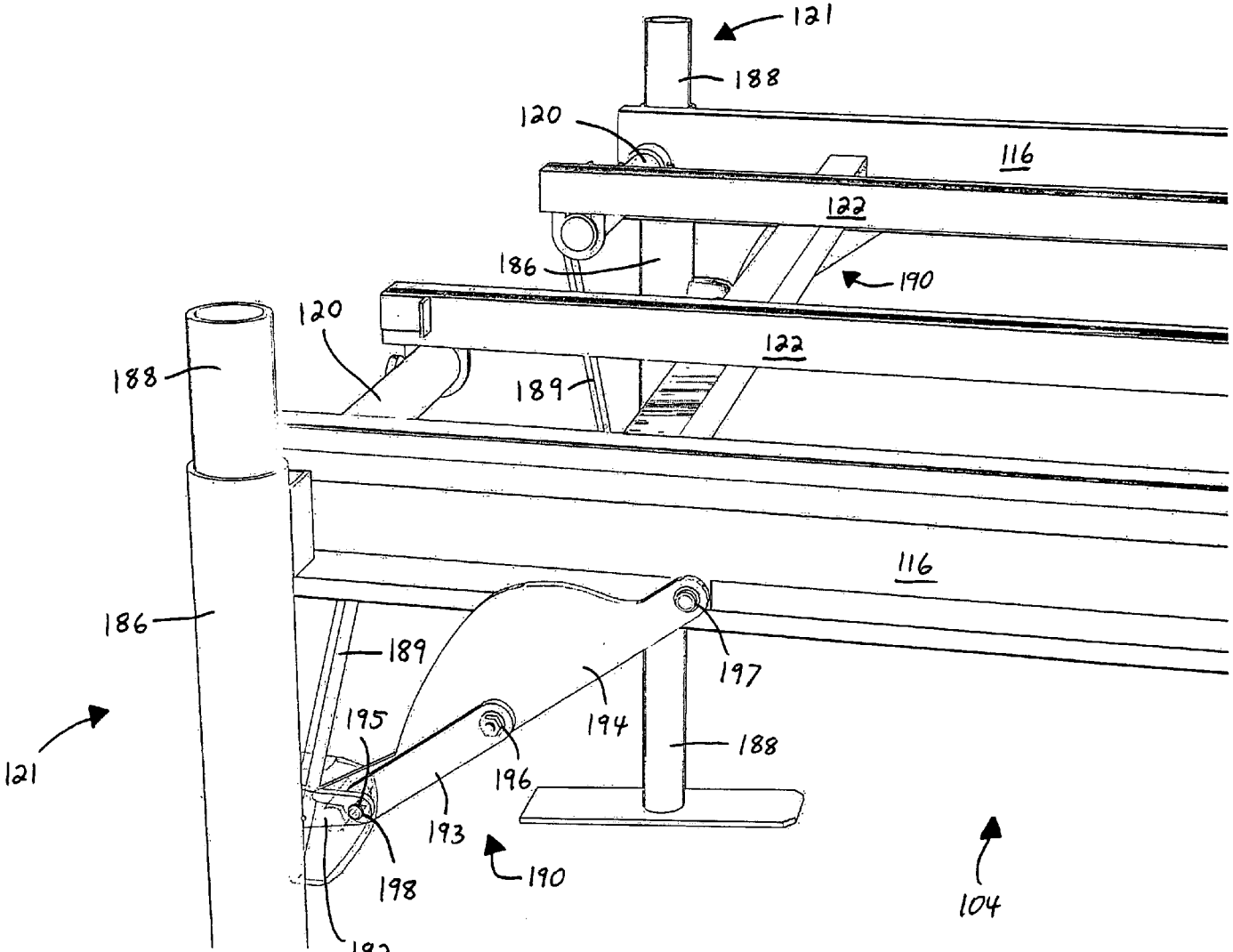
FIG. 18 illustrates an exemplary embodiment of the leg assembly of the first modular pier section.

FIG. 18 illustrates an exemplary embodiment of leg assembly 121 of first modular pier section 104. First modular pier section 104 includes longitudinal frame members 116. Leg assembly 121 includes adjustment tube 186, support post 188, lateral support 189, and scissor brace 190. Attached to adjustment tube 186 is scissor brace 190. Scissor brace 190 includes first beam 192, second beam 193, third beam 194, first pivot point 195, second pivot point 196, and third pivot point 197.

Adjustment tube 186 is a hollow tube that fits around support post 188. Support post 188 extends from adjustment tube 186 to the bottom of the lake and supports the weight of first modular pier section 104. Adjustment tube 186 is pivotally attached to a lakeward end of longitudinal frame member 116 and an outer end of catch bar 120. Lateral brace 189 is connected between adjustment tube 186 and catch bar 120 and provides lateral support to first modular pier section 104 and leg assemblies 121. First beam 192 attaches to adjustment tube 186. First beam 192 pivotally attaches to second beam 193 at first pivot point 195. Second beam 193 is also pivotally connected on the opposite end to third beam 194 at second pivot point 196. Third beam 194 is pivotally connected to longitudinal frame member 116 at third pivot point 197. Third beam 194 includes indentation 198 at an end opposite third pivot point 197. Indentation 198 is designed to fit over a head of a fastener, such as a pan head screw, a bolt, etc . . . which is placed through second beam 193 and first beam 192 at first pivot point 198. When placed over the fastener, indentation 198 is designed to hold scissor brace 190 in the fully extended position.

Figure 19:
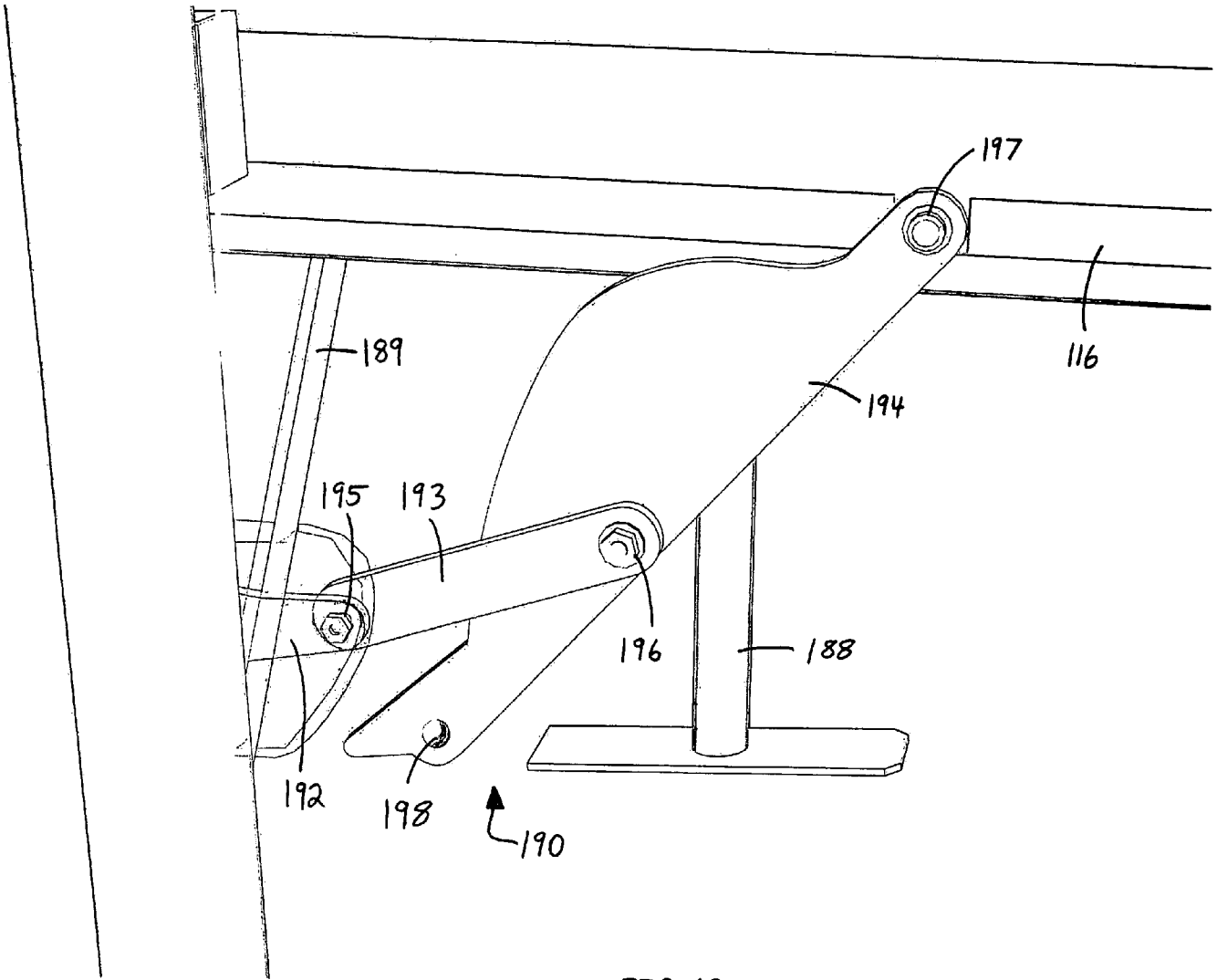
FIGS. 19–20 illustrate the folding of a scissor brace of the leg assembly.
Figure 20:
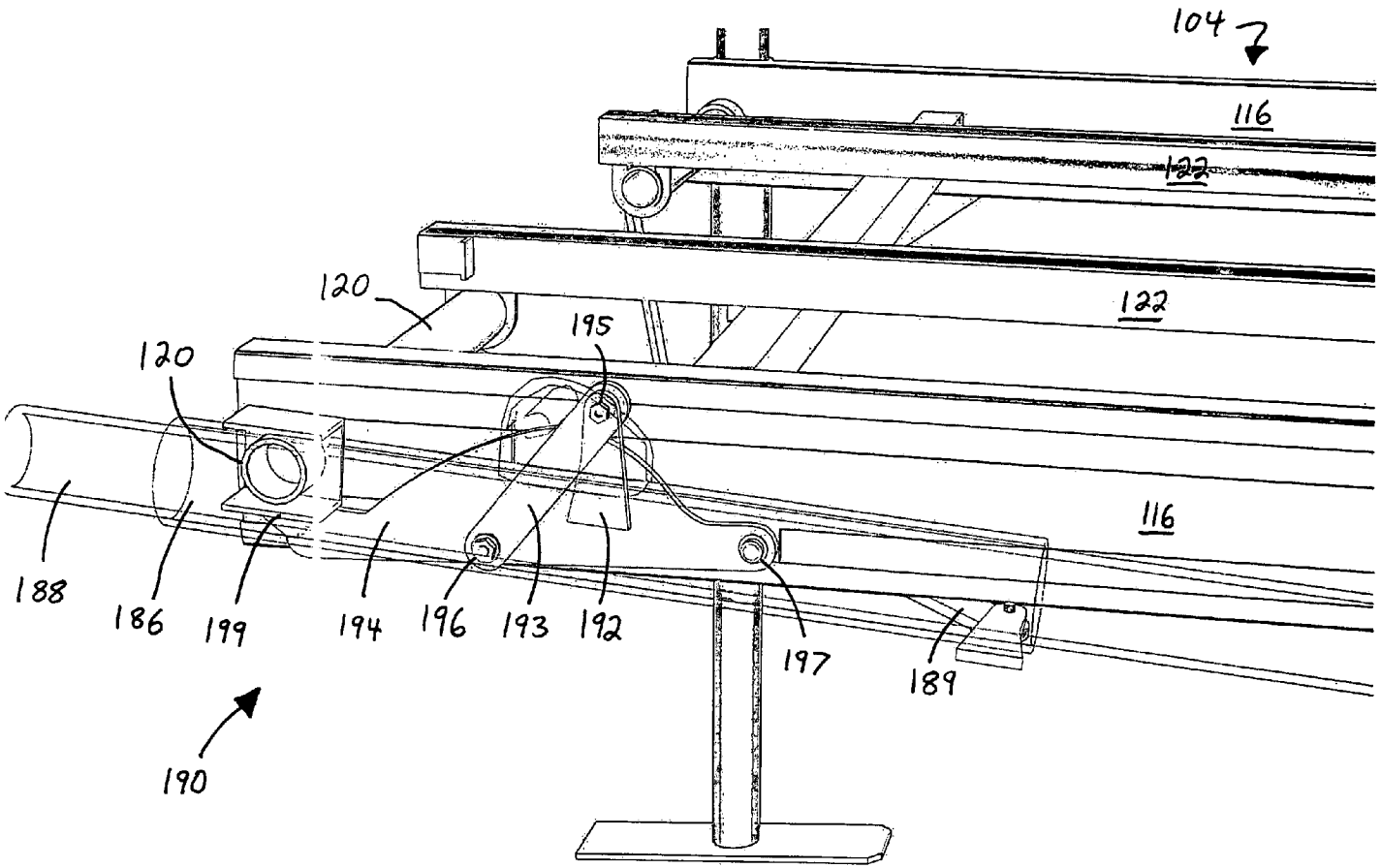

FIGS. 19–20 illustrate the folding of scissor brace 190 of leg assembly 121. Leg assembly 121 includes scissor brace 190 and stop bracket 199. Scissor brace 190 allows leg assemblies to fold to minimize the amount of storage space needed to store first modular pier section 104. To unlock scissor brace 190, the disassembler applies a force in a direction away from catch bar 120 (or in a substantially downward direction in FIG. 19) on scissor brace 190 until indentation 198 of third beam 194 disengages from the fastener (or other protrusion) at pivot point 195. Leg assembly 121 can then be folded until adjustment tube 186 lies nearly parallel to longitudinal frame member 116.

Figure 24:
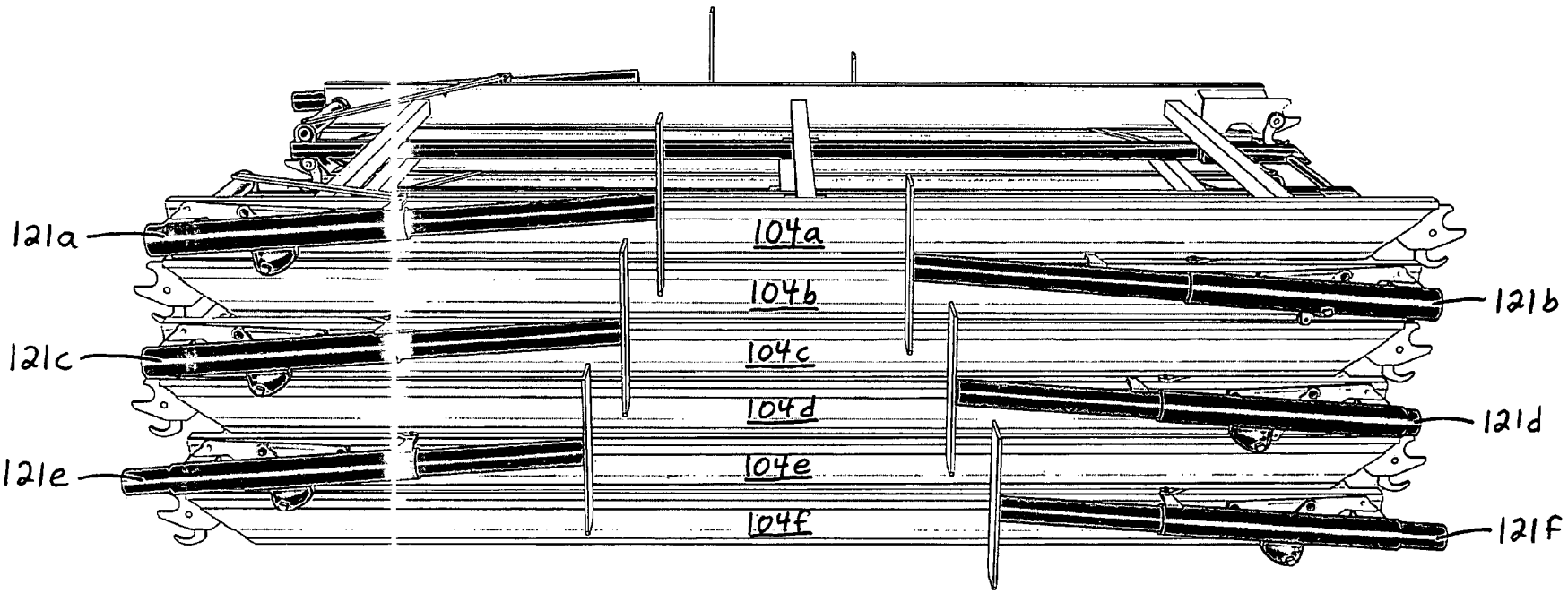
FIG. 24 illustrates a plurality of modular pier sections stacked in a storage position.

Third beam 194 of scissor brace 190 is designed to minimize risk of injury by pinching. Scissor brace 190 allows the disassembler to release the scissor brace while keeping his or her fingers away from first and second pivot points 195 and 196 and second beam 193. To release scissor brace 190, the disassembler grasps the end of third beam 194 near indentation 198 and disengages it from the fastener. In addition to this, scissor brace 190 is designed to fold only until third beam 194 comes in contact with stop bracket 199. Stop bracket 199 fits between adjustment tube 186 and longitudinal frame member 116 and includes a hole that fits around catch bar 120. Stop bracket 199 also has two flat sides. When leg assemblies 121 are retracted, third beam 194 pivots until it comes to rest on a flat side of stop bracket 199 as shown in FIG. 20. This helps to prevent leg assembly 121 from folding beyond a desired angle, which in turn makes for convenient carrying and storage. In addition, lateral brace 189 also helps to prevent leg assembly 121 from folding beyond a desired angle. When leg assembly 121 in being retracted, lateral brace 189 rotates with leg assembly 121 and catch bar 120 until lateral brace 189 comes into contact with longitudinal frame member 116. Lateral brace 189 provides the further benefit of spacing longitudinal frame members 116 from each other when stacked for storage (as shown in FIG. 24). This allows longitudinal frame members 116 to dry and reduces oxidation.

While leg assembly 121 has been described with reference to first modular pier section 104, it is recognized that leg assembly 121 could be used on any of the modular pier sections, as desired.

Pier Height Adjustment

To further improve the versatility of the modular pier of the present invention, a cam mechanism is provided to allow for the adjustment of the height of the pier. The cam mechanism can be included in any of the leg assemblies of the present invention. For illustrative purposes, an exemplary cam mechanism will be described with reference to leg assembly 121, which has been previously described.

Figure 21:
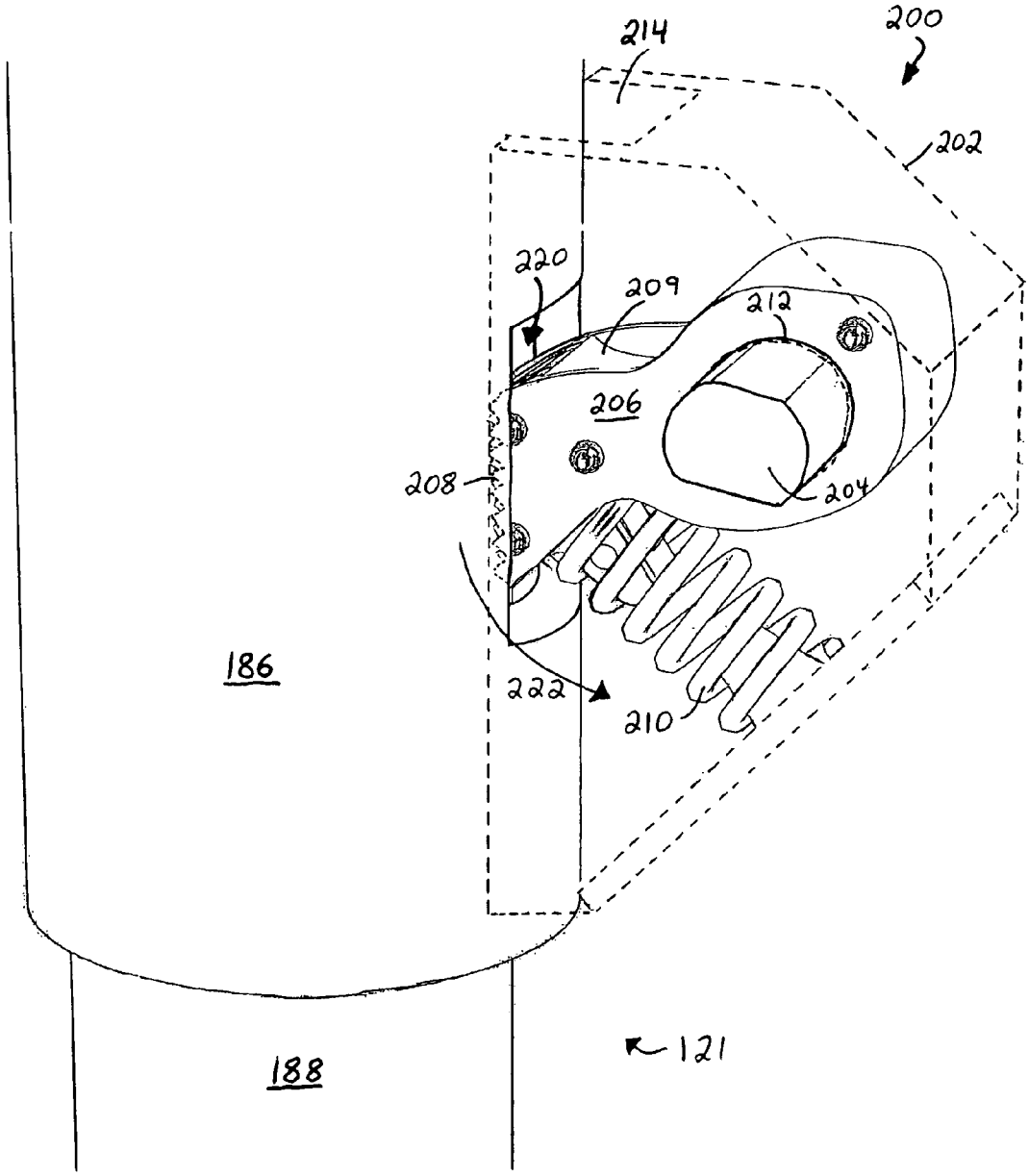
FIG. 21 is a perspective view of a cam mechanism attached to the leg assembly.

FIG. 21 is a perspective view of cam mechanism 200 attached to leg assembly 121 of the present invention. Cam mechanism 200 includes housing 202 (represented by dashed lines to allow the rest of cam mechanism 200 to be visible), shaft 204, cam arm 206 which includes teeth 208 (represented by dotted lines) and pocket 209, and spring 210. Housing 202 includes first opening 212, and second opening 214 (both represented by dashed lines). Leg assembly 121 includes adjustment tube 186, and support post 188. Adjustment tube 186 also includes slot 220. Cam mechanism 200 is rigidly mounted to adjustment tube 186 by welding or any other suitable connection. Shaft 204 extends through first opening 212 of housing 202 forming a pivotal connection between housing 202 and cam arm 206. Cam arm 206 includes teeth 208, opposite shaft 204. Spring 210 is attached at one end to cam arm 206, adjacent teeth 208, and attached to housing 202 at the other end.

Cam mechanism 200 is configured such that cam arm 206 is angled slightly downward from shaft 204. Teeth 208 of cam arm 206 engage support post 188 through slot 220 to lock support post 188 at the desired position. The downward angle of cam arm 206 causes teeth 208 to push into support post 188 when supporting the weight of the pier and engage support post 188. In addition, spring 210 provides an additional force to maintain teeth 208 engaged with support post 188 when not supporting the weight of the pier, such as when the modular pier section is being carried. In this way, support post 188 will not slip out of adjustment tube 186 unless cam arm 206 is pivoted around shaft 204 in the direction of arrow 222.

To adjust the height of the pier, cam mechanism 200 can be disengaged from support post 188. To do so, the person adjusting the height of the pier can turn shaft 204 in the direction of arrow 222 until teeth 208 of cam arm 206 have disengaged support post 188. At this point, support post 188 is free to slide up or down within adjustment tube 186. Alternately, teeth 208 of cam arm 206 can also be disengaged from support post 188 by inserting a tool, such as a rod or a screwdriver, into second opening 214 of housing 202 and pressing against pocket 209 of cam arm 206 until cam arm 206 pivots in the direction of arrow 222.

When support post 188 is in the proper position relative to adjustment tube 186, cam arm 206 can be released, by releasing shaft 204 or by removing the pressure from pocket 209. When cam arm 206 has been released, spring 210 provides a sufficient force to rotate cam arm 206 around shaft 204 such that teeth 208 once again engage support post 188. Teeth 208 of cam arm 206 are configured such that substantially all teeth 208 engage support post 188. In this way, a sufficiently large area of support post 188 is engaged such that support post 188 is not damaged or deformed by teeth 208.

It should be recognized that the cam mechanism also allows for an alternate method of adjusting pier height adjustment. The angle of cam arm 206 in relation to support post 188 and adjustment tube 186 allows support post 188 to be forced downward (such as to raise the height of the pier) without manually rotating cam arm 206. The angle of cam arm 206, however, will not let support post 188 slide up through adjustment tube 186 without cam arm 206 being manually rotated. This ensures that the pier will not give under heavy loads. Thus, an alternate method of pier height adjustment is to stand on a foot pad attached to support post 188 and lift the pier until it reaches the desired height. The cam mechanism will then automatically maintain the pier at this position.

Attaching Pier Accessories

Figure 22:
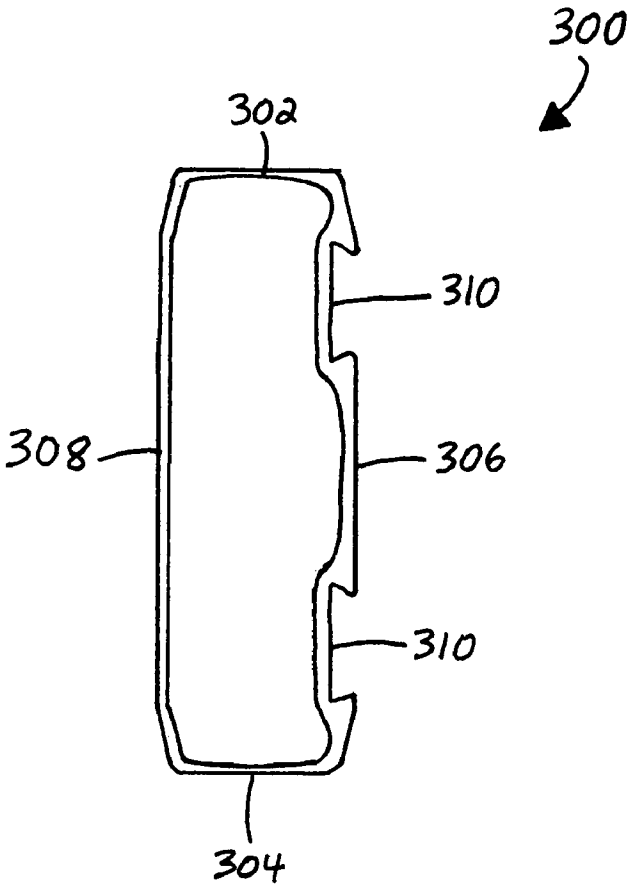
FIG. 22 is a cross-sectional view of a frame member.

FIG. 22 is a cross-sectional view of frame member 300. Frame member 300 includes top wall 302, bottom wall 304, outer wall 306, inner wall 308, and dovetail groves 310. Dovetail grooves are formed along the length of outer wall 306 of frame member 300.

To provide a method of attaching additional accessories to the pier, frame member 300 is provided. Frame member 300 is, for example, longitudinal frame members 116 located along the sides of any modular pier section. Dovetail grooves 310, in frame member 300, provide a location for attaching additional accessories to the side of the pier, such as boat bumpers, lights, mooring hardware, and ladders.

Alternate Shore Connection

While shore connection 102 was described in FIG. 2 with reference to an exemplary embodiment, another exemplary embodiment will now be described with reference to FIG. 23.

Figure 23:
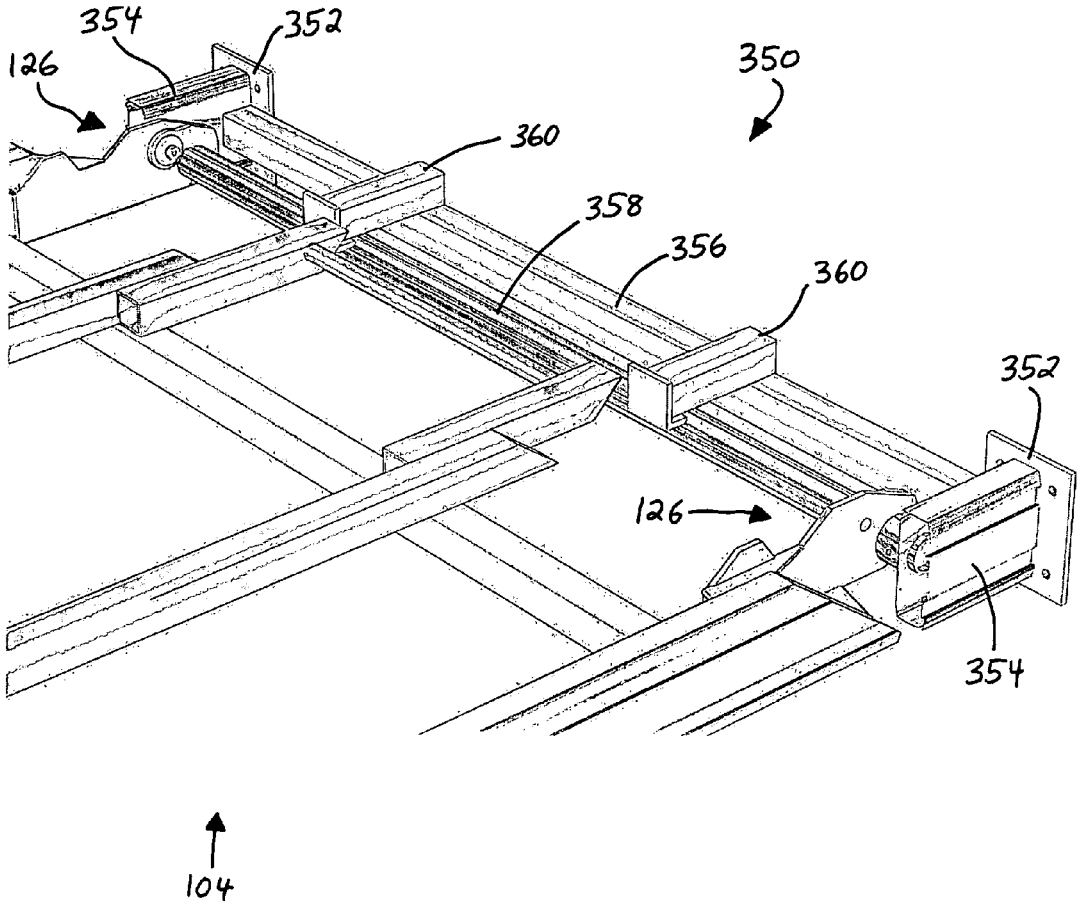
FIG. 23 illustrates an alternative shore connection.

FIG. 23 illustrates alternative shore connection 350. Shore connection 350 provides additional connection options unavailable in shore connection 102 shown in FIG. 2. Specifically, shore connection 350 allows a modular pier to be installed to a vertical or horizontal structure, such as a concrete slab, patio, wall, or other supporting structure. Shore connection 350 includes connection plates 352, longitudinal frame member 354, transverse frame member 356, catch bar 358, and frame runners 360. Connection plate 352 is designed to be screwed, bolted, or otherwise secured to a supporting structure. Longitudinal frame members 354 extend out from and normal to connection plates 352. Transverse frame member 356 and catch bar 358 are attached between longitudinal frame members 354 such that catch bar 358 is adjacent and lakeward of transverse frame member 356. Frame runners 360 are attached above transverse frame member 356 and catch bar 358. Shore connection 350 is also designed that it can be oriented in a substantially vertical position, such that connection plates rest flat against a horizontal surface.

To install shore connection 350, connection plates 352 are attached to a supporting structure located near the water such that catch bar 358 extends either upward or lakeward. A modular pier section, such as first modular pier section 104 is then attached to shore connection 350 in the manner previously described by attaching latching mechanisms 126 to catch bar 358.

Pier Storage

FIG. 24 illustrates a plurality of modular pier sections 104*a*–104*f* stacked in the storage position. Modular pier sections 104*a*–104*f* are identical to first modular pier section 104 previously described, and include leg assemblies 121*a*–121*f* respectively, which are identical to leg assembly 121 previously described. Modular pier sections 104*a*–104*f* are stacked in an upside down position such that the ends face alternating directions. In this way, modular pier sections can be stored in a compact manner, requiring minimal storage space.

Although the present invention has been described with reference to preferred embodiments, workers skilled in the art will recognize that changes may be made in form and detail without departing from the spirit and scope of the invention.

The invention claimed is:

1. A modular pier comprising:

a plurality of connectable pier sections comprising a first pier section and a second pier section wherein each pier section comprises a frame having a first end and a second end opposite the first end; and a generally cylindrical and transverse catch bar attached to the second end of the frame of each pier section; and a latch assembly attached to the first end of the frame of each pier section, the latch assembly comprising a longitudinally extending latch member having a generally arcuate notch open at an end of the latch member and shaped to receive the catch bar, and a latch hook pivotally connected to the latch member, the latch hook shaped to engage the catch bar opposite the notch to connect the first pier section to the second pier section, wherein the notch and the latch hook both engage the catch bar when the first and second pier sections are connected together in a substantially horizontal orientation to prevent longitudinal and vertical relative movement of the latch assembly and the catch bar.

2. The modular pier of claim 1, wherein each pier section further comprises:

a frame runner connected to the frame and extending substantially from the first end to the second end.

3. The modular pier of claim 1, wherein the frame of each pier section comprises:

a pair of longitudinal frame members;

a plurality of spaced transverse frame members connected at each end to the longitudinal frame members; and a plurality of frame runners connected to the transverse frame members and parallel to the longitudinal frame members.

4. The modular pier of claim 3, wherein the frame of each pier section further comprises:

a frame runner extension extending out from the plurality of frame runners at the first end of the frame configured to guide the installation of an adjacent one of the pier sections.

5. The modular pier of claim 4, the frame of each pier section further comprising:

a handle connected to the frame runner extension.

6. The modular pier of claim 3, wherein the frame of each pier section further comprises:

a frame runner extension extending out from and between the plurality of frame runners.

7. The modular pier of claim 1, wherein the catch bar comprises a first catch bar section and a second catch bar section spaced from the first catch bar section.

8. The modular pier of claim 1, wherein the latch hook of the second pier section is configured to engage the catch bar of the first pier section automatically by the force of gravity upon rotation of the latch member and the frame relative to the catch bar of the first pier section.

9. The modular pier of claim 1, wherein each of the plurality of connectable pier sections comprises:

a leg assembly pivotally connected to the second end of the frame and supported by a scissor brace, wherein the scissor brace is operable to lock the leg assembly in a fully extended position.

10. The modular pier of claim 9, wherein the leg assembly comprises:

a hollow adjustment tube pivotally connected to the second end of the frame; and a support post slidably connected within the adjustment tube.

11. The modular pier of claim 10, wherein the leg assembly further comprises a cam mechanism which locks the support post at a location relative to the adjustment tube, wherein the cam mechanism is operable to adjust the location of the support post relative to the adjustment tube.

12. The modular pier of claim 10, wherein the leg assembly further comprises a lateral brace configured to pivot with the catch bar during a retraction or an extension of the leg assembly.

13. The modular pier of claim 9, wherein the scissor brace further comprises:

a first beam having a first end and a second end opposite the first end, the first beam being rigidly connected to the adjustment tube at the first end;

a second beam having a first end and a second end opposite the first end, the first end of the second beam being pivotally attached to the second end of the first beam;

a third beam having a first end and a second end opposite the first end, the second end of the second beam being pivotally attached between the first end and the second end of the third beam, and the second end of the third beam being pivotally attached to the frame.

14. The modular pier of claim 13, wherein the third beam is configured to be grasped at the first end of the third beam such that a force applied in a direction away from the catch bar will unlock the scissor brace.

15. The modular pier of claim 9, wherein the leg assembly further comprises a cam mechanism operable to adjust the height of the pier section.

16. The modular pier of claim 1, wherein one of the plurality of modular pier sections comprises a curved pier section.

17. The modular pier of claim 1, further comprising:

a shore connection comprising two supports and a catch bar, the two supports each having a first end and a second end opposite the first end, wherein the first ends of the supports are attached to a supporting object, and the second ends of the supports are attached to opposite ends of the catch bar.

18. The modular pier of claim 17, wherein the shore connection further comprises a ramp plate attached to the catch bar and having a notch configured to engage an end of a ramp.

19. The modular pier of claim 1, further comprising:

a shore connection pivotally connected to the latch assembly of the first pier section; and a ramp pivotally connected to the shore connection and adjacent the first pier section.

20. A method of installing a modular pier having a plurality of pier sections including a first pier section and a second pier section, the method comprising:

connecting a first end of a first pier section frame to a shore next to a body of water;

placing a plurality of deck pallets on the first pier section frame to form the first pier section;

orienting a second pier section frame in a substantially upside down position and placing a generally arcuate notch of a latch plate, connected to and extending longitudinally from a first end of the second pier section frame, against a generally cylindrical. and transverse catch bar of the first pier section frame, the catch bar connected to a second end of the first pier section frame;

rotating a second end of the second pier section frame up and over the catch bar of the first pier section frame until the second pier section frame comes to rest in a substantially horizontal position, and such that a latch hook connected to the latch plate pivots by force of gravity relative to the second pier section frame to engage the catch bar of the first pier section frame opposite the notch of the latch plate of the second pier section frame, whereby longitudinal and vertical relative movement of the latch plate and the catch bar is prevented; and placing a second plurality of deck pallets on the second pier section frame to form the second pier section.

21. A modular pier comprising a plurality of pier sections, each pier section comprising:

a frame having a first end and a second end opposite the first end;

a generally cylindrical and transverse catch bar attached to the second end of the frame; and a latch assembly connected to the first end of the frame, the latch assembly comprising a longitudinally extending latch member having a generally acuate notch open at an end of the latch member and shaped to receive a generally cylindrical and transverse catch bar of an adjacent pier section and a latch hook pivotally connected to the latch member and shaped to engage the catch bar of the adjacent pier section opposite the notch, wherein the notch and the latch hook both engage the catch bar of the adjacent pier section when the pier sections are connected together in a substantially horizontal orientation to prevent longitudinal and vertical relative movement of the latch assembly of the pier section and catch bar of the adjacent pier section.

22. The modular pier of claim 21, wherein the frame further comprises a right side and a left side, both sides extending from the first end to the second end, wherein the right side and the left side of the frame include at least one catch bar allowing additional modular pier sections to be attached to at least one of the right and left sides.

* * * * *